US009202415B2

(12) United States Patent
Tseng et al.

(10) Patent No.: US 9,202,415 B2
(45) Date of Patent: Dec. 1, 2015

(54) OLED-BASED DISPLAY DEVICE INCLUDING A PIXEL CIRCUIT, AND DRIVING METHODS THEREOF

(71) Applicants: INNOCOM TECHNOLOGY (SHENZHEN) CO., LTD., Shenzhen, Guangdong Province (CN); Innolux Corporation, Miao-Li County (TW)

(72) Inventors: Ming-Chun Tseng, Miao-Li County (TW); Gong-Chen Guo, Miao-Li County (TW); Lien-Hsiang Chen, Miao-Li County (TW)

(73) Assignees: INNOCOM TECHNOLOGY (SHENZHEN) CO., LTD., Shenzhen, Guangdong Province (CN); INNOLUX CORPORATION, Miao-Li County (TW)

( * ) Notice: Subject to any disclaimer, the term of this patent is extended or adjusted under 35 U.S.C. 154(b) by 151 days.

(21) Appl. No.: 13/752,424

(22) Filed: Jan. 29, 2013

(65) Prior Publication Data

US 2013/0249875 A1 Sep. 26, 2013

(30) Foreign Application Priority Data

Mar. 21, 2012 (TW) ..... 101109690 A

(51) Int. Cl.
*G09G 3/32* (2006.01)

(52) U.S. Cl.
CPC ..... *G09G 3/3266* (2013.01); *G09G 3/3233* (2013.01); *G09G 2300/0852* (2013.01); *G09G 2300/0861* (2013.01)

(58) Field of Classification Search
CPC ..... G06F 3/0414; G09G 3/3233; G09G 2300/0852; G09G 2300/0861; G09G 3/30
See application file for complete search history.

(56) References Cited

U.S. PATENT DOCUMENTS

| | | | |
|---|---|---|---|
| 7,714,813 B2 | 5/2010 | Uchino et al. | |
| 7,983,379 B2 * | 7/2011 | Ieong et al. | 377/64 |
| 8,344,970 B2 | 1/2013 | Fish et al. | |

(Continued)

FOREIGN PATENT DOCUMENTS

| | | |
|---|---|---|
| CN | 1716370 A | 1/2006 |
| CN | 101283393 A | 10/2008 |

(Continued)

OTHER PUBLICATIONS

TW Search Report dated Apr. 14, 2014.

(Continued)

*Primary Examiner* — Sejoon Ahn
(74) *Attorney, Agent, or Firm* — McClure, Qualey & Rodack, LLP

(57) ABSTRACT

An organic light emitting diode (OLED) based display device including a pixel circuit that includes: an OLED to be connected to a first power terminal, a transistor connected to the OLED, a first capacitor connected to the transistor, a second capacitor connected to the first capacitor and the transistor, a first switch receiving a data signal and a scanning signal and connected to the first capacitor, a second switch connected to the transistor and receiving an enable signal, a third switch connected to the transistor and receiving a compensation signal, and a switching unit configured to transmit one of the enable signal, voltage at a terminal of the first capacitor, a reference signal and the scanning signal to a terminal of the transistor when operated in a conductive state.

2 Claims, 19 Drawing Sheets

(56) References Cited

U.S. PATENT DOCUMENTS

| | | | | |
|---|---|---|---|---|
| 2003/0112208 | A1* | 6/2003 | Okabe et al. | 345/82 |
| 2004/0070557 | A1* | 4/2004 | Asano et al. | 345/76 |
| 2005/0052366 | A1* | 3/2005 | Kim | 345/76 |
| 2005/0206591 | A1 | 9/2005 | Wang et al. | |
| 2006/0028408 | A1 | 2/2006 | Kim | |
| 2006/0097966 | A1* | 5/2006 | Choi | 345/77 |
| 2006/0156121 | A1* | 7/2006 | Chung | 714/726 |
| 2006/0170634 | A1* | 8/2006 | Kwak et al. | 345/92 |
| 2006/0232678 | A1* | 10/2006 | Choi et al. | 348/207.11 |
| 2006/0244390 | A1* | 11/2006 | Yang | 315/169.3 |
| 2007/0057873 | A1* | 3/2007 | Uchino et al. | 345/76 |
| 2007/0164940 | A1* | 7/2007 | Guo et al. | 345/76 |
| 2007/0279403 | A1* | 12/2007 | Uchino et al. | 345/205 |
| 2008/0036710 | A1* | 2/2008 | Kim | 345/82 |
| 2008/0180038 | A1* | 7/2008 | Wang et al. | 315/246 |
| 2008/0225025 | A1* | 9/2008 | Uchino et al. | 345/204 |
| 2011/0193843 | A1* | 8/2011 | Uchino et al. | 345/210 |

FOREIGN PATENT DOCUMENTS

| | | | |
|---|---|---|---|
| CN | 101996579 | A | 3/2011 |
| TW | I243352 | B | 11/2005 |

OTHER PUBLICATIONS

English translation of TW Search Report dated Apr. 14, 2014.
CN Search Report dated Oct. 23, 2014.
English translation of CN Search Report dated Oct. 23, 2014.
Full English (machine) translation of CN101996579 (Published Mar. 30, 2011).

* cited by examiner

OLED-BASED DISPLAY DEVICE INCLUDING A PIXEL CIRCUIT, AND DRIVING METHODS THEREOF

CROSS-REFERENCE TO RELATED APPLICATION

This application claims priority of Taiwanese Application No. 101109690, filed on Mar. 21, 2012.

BACKGROUND OF THE INVENTION

1. Field of the Invention

The present invention relates to a pixel circuit, more particularly to a pixel circuit for an organic light emitting diode (OLED) based display device.

2. Description of the Related Art

Organic light emitting diode (OLED) based display devices have the advantages of self-illumination, high brightness, fast response times, and wide viewing angles, and have been employed in various applications.

An OLED display device uses an array of pixel circuits capable of displaying different colors. Moreover, control of illumination intensities of the pixel circuits is performed sequentially through either rows or columns of the array. Each pixel circuit includes an OLED, and is operable for generating a driving current for driving the OLED thereof. Illumination intensity of light emitted by each OLED is related to a magnitude of the corresponding driving current.

Referring to FIGS. 1 and 2, a conventional pixel circuit includes an OLED 11, a first transistor 12, a second transistor 13, a third transistor 14, a fourth transistor 15, a fifth transistor 16, a sixth transistor 17, a first capacitor 18, and a second capacitor 19. Each of the transistors 12-17 is an n-type thin-film transistor (TFT).

The conventional pixel circuit receives a data signal, a first scanning signal, an enable signal, a complementary enable signal, a second scanning signal, a reference signal and a reset signal. Operation of the conventional pixel circuit may be divided into a compensation phase, an light-emission phase, and a reset phase.

In the compensation phase, a source of the second transistor 13 has a voltage of $V_{DATA}-V_T$, where "$V_{DATA}$" is a voltage of the data signal and "$V_T$" is a threshold voltage of the second transistor 13.

In the light-emission phase, a voltage "$V_{OLED_A}$" at an anode of the OLED 11 and the threshold voltage "$V_T$" of the second transistor 13 are coupled to a gate of the second transistor 13 through the second capacitance 19, such that a voltage "$V_G$" at the gate of the second transistor 13 satisfies the relationships of $$V_G=V_{REF}+(V_{OLED_A}-V_{DATA}+V_T)f, \text{ and}$$

$$f=C_2/(C_2+C_P)$$

where "$V_{REF}$" represents a voltage of the reference signal, "$C_2$" represents a capacitance value of the second capacitor 19, and "$C_p$" represents a capacitance value of a parasitic capacitor associated with the gate of the second transistor 13.

The second transistor 13 generates a driving current "$I_{DRIVE}$" satisfying the relationship of $$I_{DRIVE} = \frac{1}{2}\mu C_{OX}\frac{W}{L}[V_{REF} + (V_{OLED_A} - V_{DATA} + V_T)f - V_{OLED_A} - V_T]^2$$

-continued $$= k[V_{REF} - V_{DATA}f + (V_{OLED_A} + V_T)(f-1)]^2$$

where "W/L" represent a width-to-length ratio of the second transistor 13.

In an ideal scenario where the capacitance value $C_2$ is significantly greater than the capacitance value $C_p$ (i.e., $C_2 >> C_p$), "f" is substantially equal to one, and the aforesaid relationship may be simplified into $I_{DRIVE} \approx k(V_{REF}-V_{DATA})^2$, such that the driving current "$I_{DRIVE}$" is substantially unrelated to the threshold voltage "$V_T$" of the second transistor 13 and the voltage "$V_{OLED_A}$" at the anode of the OLED 11.

In practice, however, it may be difficult to achieve the configuration of the aforementioned ideal scenario due to space constraints. Although the conventional pixel circuit is able to compensate, to a certain extent, influence of changes of the threshold voltage "$V_T$" of the second transistor 13 upon the driving current "$I_{DRIVE}$", the driving current "$I_{DRIVE}$" is still related to the threshold voltage "$V_T$" and hence is still susceptible to influence of changes in the threshold voltage "$V_T$".

SUMMARY OF THE INVENTION

Therefore, an object of the present invention is to provide an organic liquid emitting diode (OLED) based display device including a pixel circuit that is able to alleviate the influence of changes in threshold voltage on driving current for an OLED of the pixel circuit.

According to the present invention, there is provided an OLED-based display device including a pixel circuit that includes:

an organic light emitting diode (OLED) having an anode and a cathode to be connected electrically to a first power terminal;

a transistor having a first terminal, a second terminal that is connected electrically to the anode of the OLED, and a control terminal;

a first capacitor having a first terminal and a second terminal that is connected electrically to the control terminal of the transistor;

a second capacitor having a first terminal that is connected electrically to the first terminal of the first capacitor, and a second terminal that is connected electrically to the second terminal of the transistor;

a first switch having a first terminal that is disposed to receive a data signal, a second terminal that is connected electrically to the first terminal of the first capacitor, and a control terminal that is disposed to receive a scanning signal, the first switch being operable to switch between a conductive state and a non-conductive state according to the scanning signal received by the first switch;

a second switch having a first terminal that is to be connected electrically to a second power terminal, a second terminal that is connected electrically to the first terminal of the transistor, and a control terminal that is disposed to receive an enable signal, the second switch being operable to switch between a conductive state and a non-conductive state according to the enable signal received by the second switch;

a third switch having a first terminal that is connected electrically to the first terminal of the transistor, a second terminal that is connected electrically to the control terminal of the transistor, and a control terminal that is disposed to receive a compensation signal, the third switch being operable to switch between a conductive state and a non-conductive state according to the compensation signal received by the third switch; and a switching unit connected electrically to the second terminal of the transistor, disposed to receive the compensation signal, and operable to switch between a conductive state and a non-conductive state according to the compensation signal received by the switching unit.

The switching unit is configured to transmit one of the enable signal, voltage at the first terminal of the first capacitor, a reference signal and the scanning signal to the second terminal of the transistor when the switching unit is operated in the conductive state.

In one embodiment, the switching unit includes a fourth switch having a first terminal, a second terminal that is connected electrically to the second terminal of the transistor, and a control terminal that is disposed to receive the compensation signal. The first terminal of the fourth switch is disposed to receive one of the enable signal, the voltage at the first terminal of the first capacitor, the reference signal and the scanning signal.

The fourth switch permits transmission of said one of the enable signal, the voltage at the first terminal of the first capacitor, the reference signal and the scanning signal therethrough to the second terminal of the transistor when the switching unit is operated in the conductive state, and prevents transmission of said one of the enable signal, the voltage at the first terminal of the first capacitor, the reference signal and the scanning signal therethrough to the second terminal of the transistor when the switching unit is operated in the non-conductive state.

A driving method for driving a pixel circuit of an organic light emitting diode based display device according to said one embodiment comprises:

(A) applying the data signal, the scanning signal, the enable signal, and the compensation signal to the pixel circuit such that the OLED is in the non-conductive state, the transistor is in the non-conductive state, the first switch is in the conductive state, the second switch is in the conductive state, the third switch is in the non-conductive state, and the switching unit is in the non-conductive state;

(B) applying the data signal, the scanning signal, the enable signal, and the compensation signal to the pixel circuit such that the OLED is in the non-conductive state, the transistor switches from the conductive state to the non-conductive state, the first switch is in the conductive state, the second switch is in the non-conductive state, the third switch is in the conductive state, and the switching unit is in the conductive state;

(C) applying the data signal, the scanning signal, the enable signal, and the compensation signal to the pixel circuit such that the OLED is in the non-conductive state, the transistor is in the conductive state, the first switch is in the conductive state, the second switch is in the non-conductive state, the third switch is in the non-conductive state, and the switching unit is in the non-conductive state; and (D) applying the scanning signal, the enable signal, and the compensation signal to the pixel circuit such that the OLED is in the conductive state, the transistor is in the conductive state, the first switch is in the non-conductive state, the second switch is in the conductive state, the third switch is in the non-conductive state, and the switching unit is in the non-conductive state.

In another embodiment, the switching unit further includes a fifth switch having a first terminal, a second terminal that is connected electrically to the first terminal of the first capacitor, and a control terminal that is disposed to receive the compensation signal. The first terminal of the fifth switch is disposed to receive one of the enable signal, a voltage at the second terminal of the transistor, the reference signal and the scanning signal.

The fifth switch permits transmission of said one of the enable signal, the voltage at the second terminal of the transistor, the reference signal and the scanning signal therethrough to the first terminal of the first capacitor when the switching unit is operated in the conductive state, and prevents transmission of said one of the enable signal, the voltage at the second terminal of the transistor, the reference signal and the scanning signal therethrough to the first terminal of the first capacitor when the switching unit is operated in the non-conductive state.

A driving method for driving a pixel circuit of an organic light emitting diode based display device according to said another embodiment comprises:

(A) applying the data signal, the scanning signal, the enable signal, and the compensation signal to the pixel circuit such that the OLED is in the non-conductive state, the transistor is in the non-conductive state, the first switch is in the conductive state, the second switch is in the conductive state, the third switch is in the non-conductive state, and the switching unit is in the non-conductive state;

(B) applying the scanning signal, the enable signal, and the compensation signal to the pixel circuit such that the OLED is in the non-conductive state, the transistor switches from the conductive state to the non-conductive state, the first switch is in the non-conductive state, the second switch is in the non-conductive state, the third switch is in the conductive state, and the switching unit is in the conductive state;

(C) applying the data signal, the scanning signal, the enable signal, and the compensation signal to the pixel circuit such that the OLED is in the non-conductive state, the transistor is in the conductive state, the first switch is in the conductive state, the second switch is in the non-conductive state, the third switch is in the non-conductive state, and the switching unit is in the non-conductive state; and (D) applying the scanning signal, the enable signal, and the compensation signal to the pixel circuit such that the OLED is in the conductive state, the transistor is in the conductive state, the first switch is in the non-conductive state, the second switch is in the conductive state, the third switch is in the non-conductive state, and the switching unit is in the non-conductive state.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
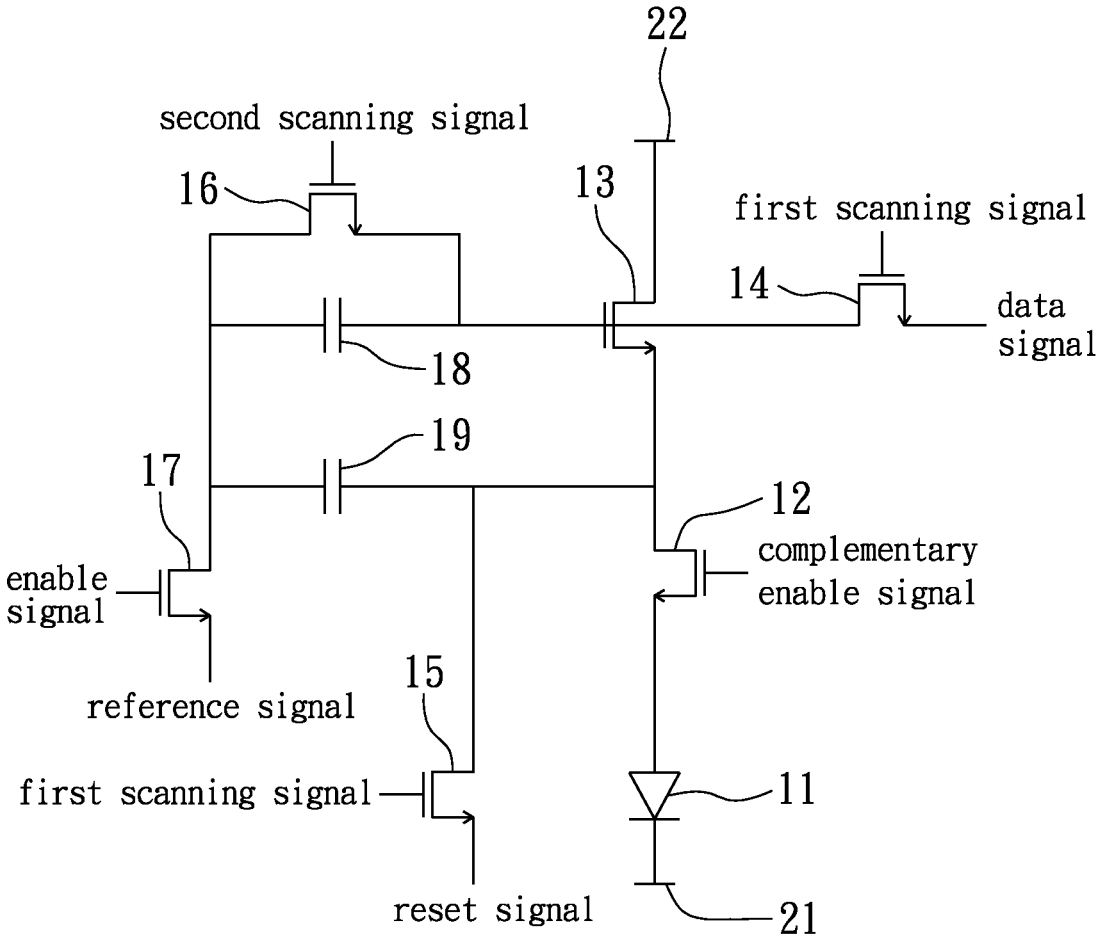
FIG. 1 PRIOR ART
FIG. 1 is a schematic circuit diagram of a conventional pixel circuit.
Figure 2:
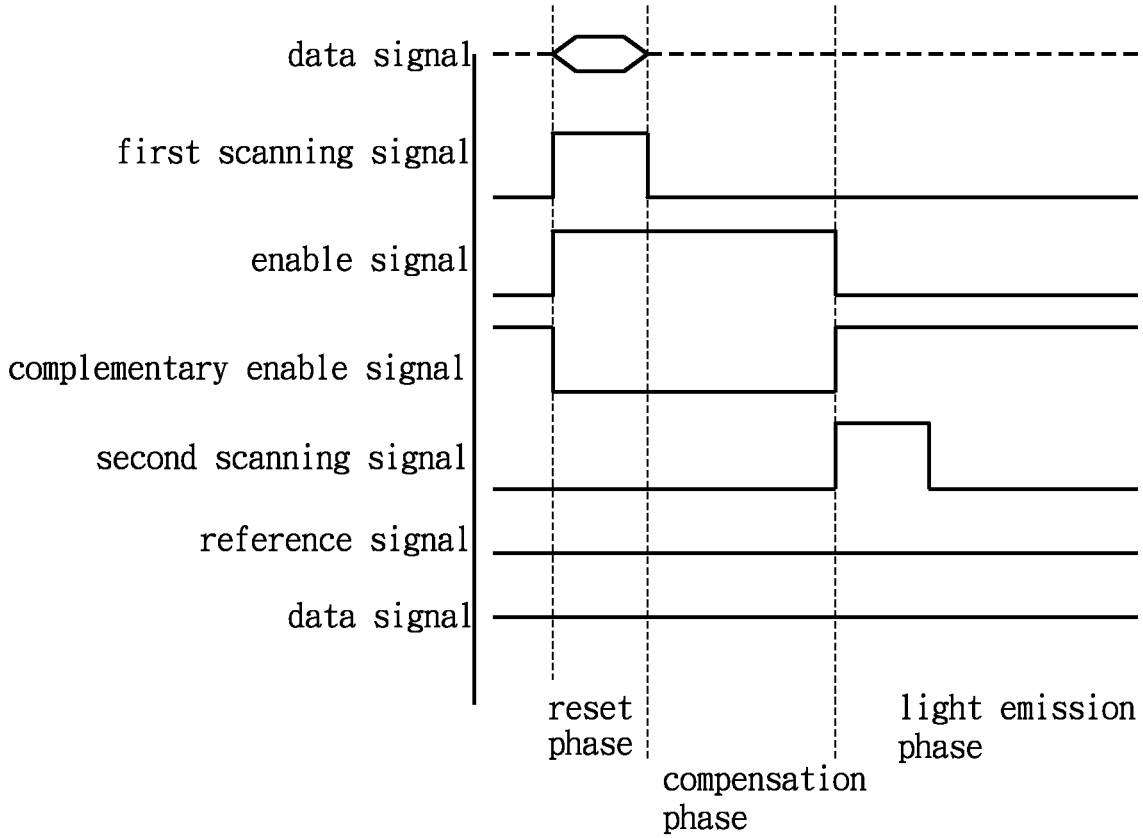
FIG. 2 PRIOR ART
FIG. 2 is a timing diagram of the conventional pixel circuit shown in FIG. 1.

Before the present invention is described in greater detail, it should be noted that like elements are denoted by the same reference numerals throughout the disclosure.

Figure 3:
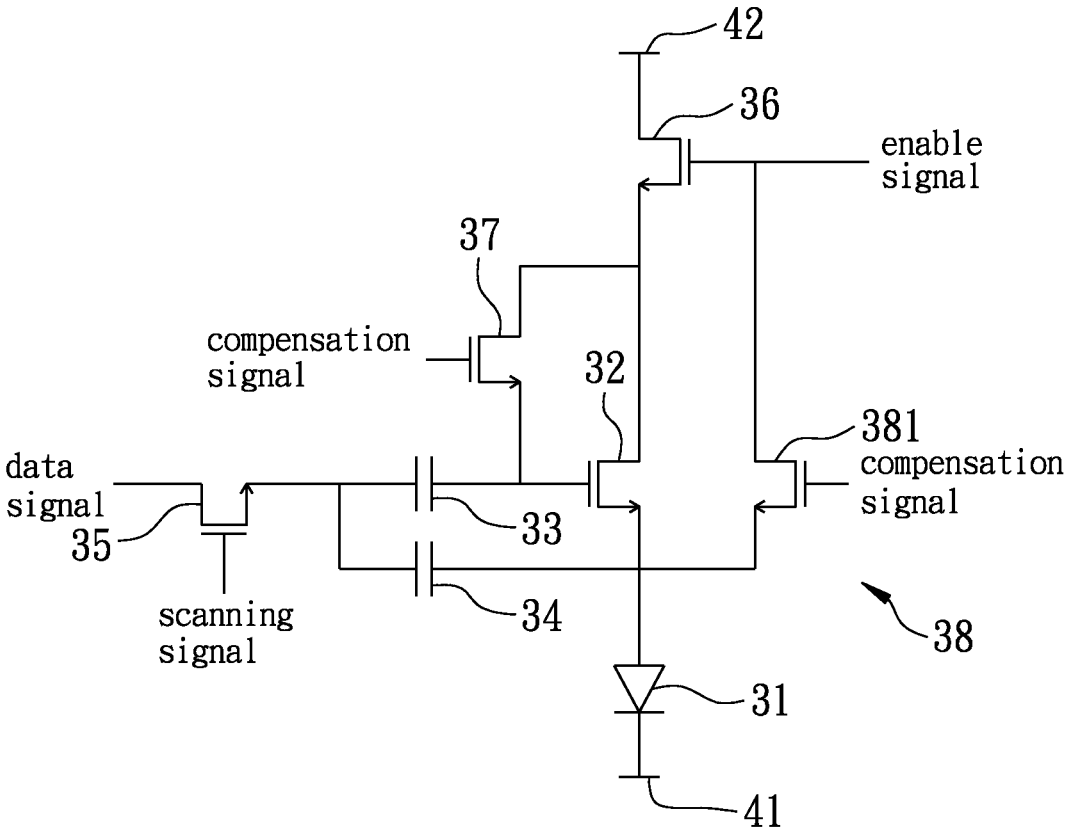
FIG. 3 is a schematic circuit diagram of the first preferred embodiment of a pixel circuit for an OLED-based display device according to the present invention.

Referring to FIG. 3, the first preferred embodiment of a pixel circuit for an organic light emitting diode (OLED) based display device according to the present invention includes an OLED 31, a transistor 32, a first capacitor 33, a second capacitor 34, a first switch 35, a second switch 36, a third switch 37, and a switching unit 38.

The OLED 31 has an anode and a cathode to be connected electrically to a first power terminal 41.

The transistor 32 has a first terminal, a second terminal connected electrically to the anode of the OLED 31, and a control terminal.

The first capacitor 33 has a first terminal and a second terminal that is connected electrically to the control terminal of the transistor 32.

The second capacitor 34 has a first terminal that is connected electrically to the first terminal of the first capacitor 33, and a second terminal that is connected electrically to the second terminal of the transistor 32.

The first switch 35 has a first terminal that is disposed to receive a data signal, a second terminal that is connected electrically to the first terminal of the first capacitor 33, and a control terminal that is disposed to receive a scanning signal. The first switch 35 is operable to switch between a conductive state, where transmission of the data signal therethrough to the first terminal of the first capacitor 33 is permitted, and a non-conductive state, where transmission of the data signal therethrough to the first terminal of the first capacitor 33 is prevented, according to the scanning signal.

The second switch 36 has a first terminal that is to be connected electrically to a second power terminal 42, a second terminal that is connected electrically to the first terminal of the transistor 32, and a control terminal that is disposed to receive an enable signal. The second switch 36 is operable to switch between a conductive state, where transmission of a voltage "$V_{DD}$" at the second power terminal 42 therethrough to the first terminal of the transistor 32 is permitted, and a non-conductive state, where transmission of the voltage "$V_{DD}$" at the second power terminal 42 therethrough to the first terminal of the transistor 32 is prevented, according to the enable signal.

The third switch 37 has a first terminal connected electrically to the first terminal of the transistor 32, a second terminal connected electrically to the control terminal of the transistor 32, and a control terminal disposed to receive a compensation signal. The third switch 37 is operable to switch between a conductive state and a non-conductive state according to the compensation signal received by the third switch 37.

The switching unit 38 is connected electrically to the second terminal of the transistor 32, is disposed to receive the compensation signal, and is operable to switch between a conductive state and a non-conductive state according to the compensation signal received by the switching unit 38.

In this embodiment, the transistor 32 is an n-type thin-film transistor (TFT). The switching unit 38 includes a fourth transistor 381 having a first terminal disposed to receive the enable signal, a second terminal connected electrically to the second terminal of the transistor 32, and a control terminal disposed to receive the compensation signal. The fourth switch 381 permits transmission of the enable signal therethrough to the second terminal of the transistor when the switching unit 38 is operated in the conductive state, and prevents transmission of the enable signal therethrough to the second terminal of the transistor 32 when the switching unit 38 is operated in the non-conductive state.

Preferably, each of the first switch 35, the second switch 36, the third switch 37, and the fourth switch 381 is an n-type TFT.

Figure 4:
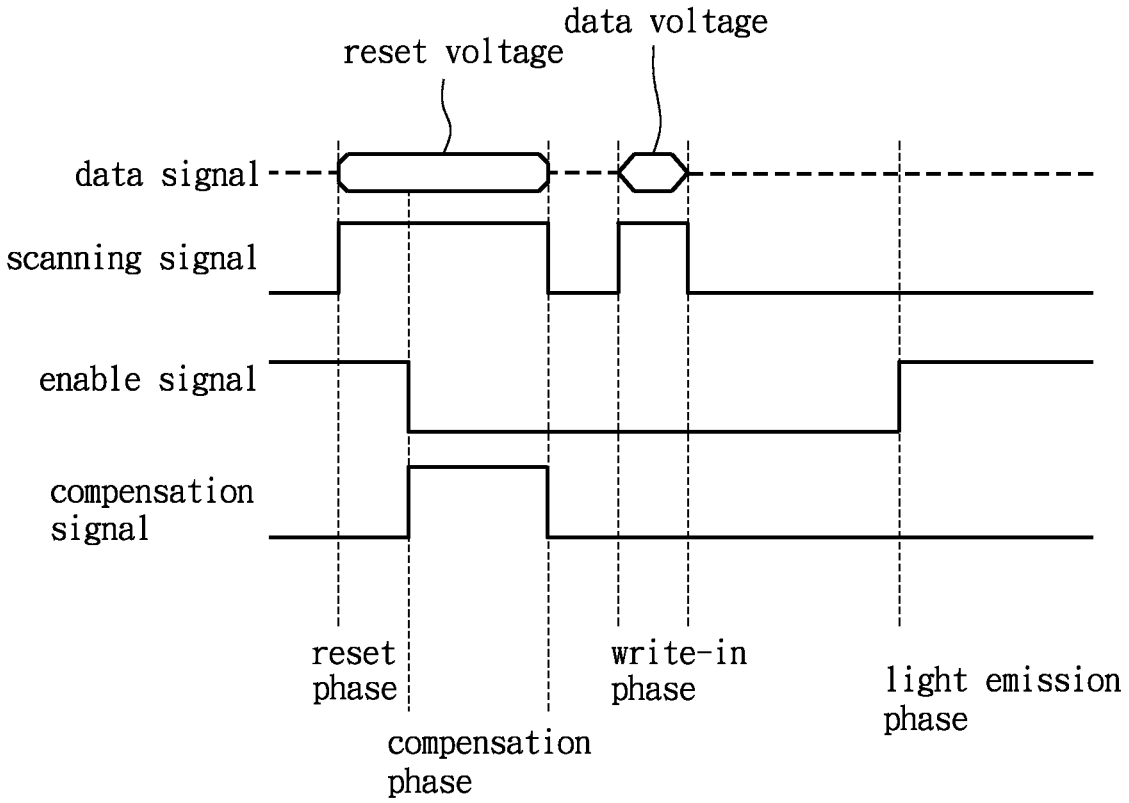
FIGS. 4 and 5 are timing diagrams of the first preferred embodiment.

With further reference to FIG. 4, operation of the pixel circuit may be divided into a reset phase, a compensation phase, a write-in phase, and an light-emission phase.

In the reset phase, the data signal is at a reset voltage "$V_{RST}$", the scanning signal is at a logic high voltage "$V_H$", the enable signal is at the logic high voltage "$V_H$", the compensation signal is at a logic low voltage "$V_L$", the OLED 31 is in a non-conductive state, the transistor 32 is in the non-conductive state, the first switch 35 is in the conductive state, the second switch 36 is in the conductive state, the third switch 37 is in the non-conductive state, and the fourth switch 381 of the switching unit 38 is in the non-conductive state.

Thus, the voltage "$V_{DD}$" at the second power terminal 42 is transmitted through the second switch 36 to the first terminal of the transistor 32. The data signal is transmitted through the first switch 35 and coupled through the first capacitor 33 to the control terminal of the transistor 32, such that a voltage at the first terminal of the first capacitor 33 corresponds to the reset voltage "$V_{RST}$", and that a voltage at the control terminal of the transistor 32 corresponds to a sum of the logic low voltage "$V_L$" and a threshold voltage "$V_T$" of the transistor 32 (i.e., $V_L+V_T$). It is to be noted that the first capacitor 33 has a cross-voltage corresponding to "$V_L+V_T-V_{RST}$" of the transistor 32 due to the previous phase.

The transistor 32 is in the non-conductive state when the pixel circuit satisfies the relationship of $$(V_L+V_T)-[V_{SS}+V_{OLED}(0)]<V_T \Rightarrow <V_{SS}+V_{OLED}(0)$$

where "$V_{SS}$" represents a voltage at the first power terminal 41, and "$V_{OLED}$ (0)" represents a threshold voltage of the OLED 31.

In the compensation phase, the data signal is at the reset voltage "$V_{RST}$", the scanning signal is at the logic high voltage "$V_H$", the enable signal is at the logic low voltage "$V_L$", the compensation signal is at the logic high voltage "$V_H$", the OLED 31 is in the non-conductive state, the transistor 32 switches from the conductive state to the non-conductive state, the first switch 35 is in the conductive state, the second switch 36 is in the non-conductive state, the third switch 37 is in the conductive state, and the fourth switch 381 of the switching unit 38 is in the conductive state.

Thus, the data signal is transmitted through the first switch 35 to the first terminal of the first capacitor 33, such that the voltage at the first terminal of the first capacitor 33 corresponds to the reset voltage "$V_{RST}$". The enable signal is transmitted through the fourth switch 381 to the second terminal of the transistor 32, such that a voltage at the second terminal of the transistor 32 corresponds to the logic low voltage "$V_L$".

Since the third switch 37 is in the conductive state, the voltage at the control terminal of the transistor 32 is increased, causing the transistor 32 to switch to the conductive state and causing a voltage at the first terminal of the transistor 32 and the voltage at the control terminal of the transistor 32 to correspond to the sum of the logic low voltage "$V_L$" and the threshold voltage "$V_T$" of the transistor 32 (i.e., $V_L+V_T$). Subsequently, the transistor 32 switches to the non-conductive state.

In the write-in phase, the data signal is at a data voltage "$V_{DATA}$", the scanning signal is at the logic high voltage "$V_H$", the enable signal is at the logic low voltage "$V_L$", the compensation signal is at the logic low voltage "$V_L$", the OLED 31 is in the non-conductive state, the transistor 32 is in the conductive state, the first switch 35 is in the conductive state, the second switch 36 is in the non-conductive state, the third switch 37 is in the non-conductive state, and the fourth switch 381 of the switching unit 38 is in the non-conductive state.

Thus, the data signal is transmitted through the first switch 35, and coupled respectively through the first capacitor 33 and the second capacitor 34 to the control terminal and the second terminal of the transistor 32: such that the voltage at the first terminal of the first capacitor 33 corresponds to the data voltage "$V_{DATA}$"; that the voltage at the control terminal of the transistor 32 corresponds to a result of ($V_L+V_T+V_{DATA}-V_{RST}$); and that the voltage at the second terminal of the transistor 32 corresponds to a result of ($V_L+(V_{DATA}-V_{RST})f_1$), where "$f_1$" is equal to ($C_2/(C_2+C_{P1})$), "$C_2$" represents a capacitance value of the second capacitor 34, and "$C_{P1}$" represents a capacitance value of a parasitic capacitor associated with the second terminal of the transistor 32.

The OLED 31 is in the non-conductive state and the transistor 32 is in the conductive state when the pixel circuit satisfies the relationships of $$V_L + (V_{DATA} - V_{RST})f_1 < V_{SS} + V_{OLED}(0) \Rightarrow f_1 < \frac{V_{SS} + V_{OLED}(0) - V_L}{V_{DATA} - V_{RST}},$$

and $$(V_L + V_T + V_{DATA} - V_{RST}) - [V_L + (V_{DATA} - V_{RST})f_1] > V_T \Rightarrow V_{DATA} - V_{RST} > 0$$

In the light-emission phase, the scanning signal is at the logic low voltage "$V_L$", the enable signal is at the logic high voltage "$V_H$", the compensation signal is at the logic low voltage "$V_L$", the OLED 31 is in a conductive state, the transistor 32 is in the conductive state, the first switch 35 is in the non-conductive state, the second switch 36 is in the conductive state, the third switch 37 is in the non-conductive state, and the fourth switch 381 of the switching unit 38 is in the non-conductive state.

Thus, the first terminal of the first capacitor 33 is in a floating state, and the voltage "$V_{OLED_A}$" at the second terminal of the transistor 32 is related to the OLED 31 and is coupled to the control terminal of the transistor 32 via the second capacitor 34, causing the voltage $V_G$ at the control terminal of the transistor 32 to satisfy the relationship of $$\begin{aligned} V_G &= (V_L + V_T + V_{DATA} - V_{RST}) + \lfloor V_{OLED_A} - V_L - (V_{DATA} - V_{RST})f_1 \rfloor f_2 \\ &= (V_{DATA} - V_{RST})(1 - f_3) + V_L(1 - f_2) + V_{OLED_A} f_2 + V_T \end{aligned}$$

where "$f_2$" is equal to $C_2/(C_2+C_{P2})$, "$C_{P2}$" is a capacitance value of a parasitic capacitor associated with the first terminal of the first capacitor 33, and "$f_3$" is equal to a product of "$f_1$" and "$f_2$".

The driving current "$I_{DRIVE}$" generated by the transistor 32 satisfies the relationship of $$I_{DRIVE} = \frac{1}{2}\mu C_{OX}\frac{W}{L}[(V_{DATA} - V_{RST})(1 - f_3) + (V_L - V_{OLED_A})(1 - f_2)]^2$$

It is apparent from at least the aforementioned relationship that the driving current "$I_{DRIVE}$" and the threshold voltage "$V_T$" are not related to each other. Therefore, the pixel circuit of the first preferred embodiment is capable of alleviating influence of changes in the threshold voltage "$V_T$" upon the driving current "$I_{DRIVE}$".

In addition, the pixel circuit of the first preferred embodiment includes fewer components and receives fewer signals in comparison with the conventional pixel circuit. Thus, the pixel circuit of the first preferred embodiment may have a relatively small circuit layout area, which is favorable for increasing area of light emission.

Figure 5:
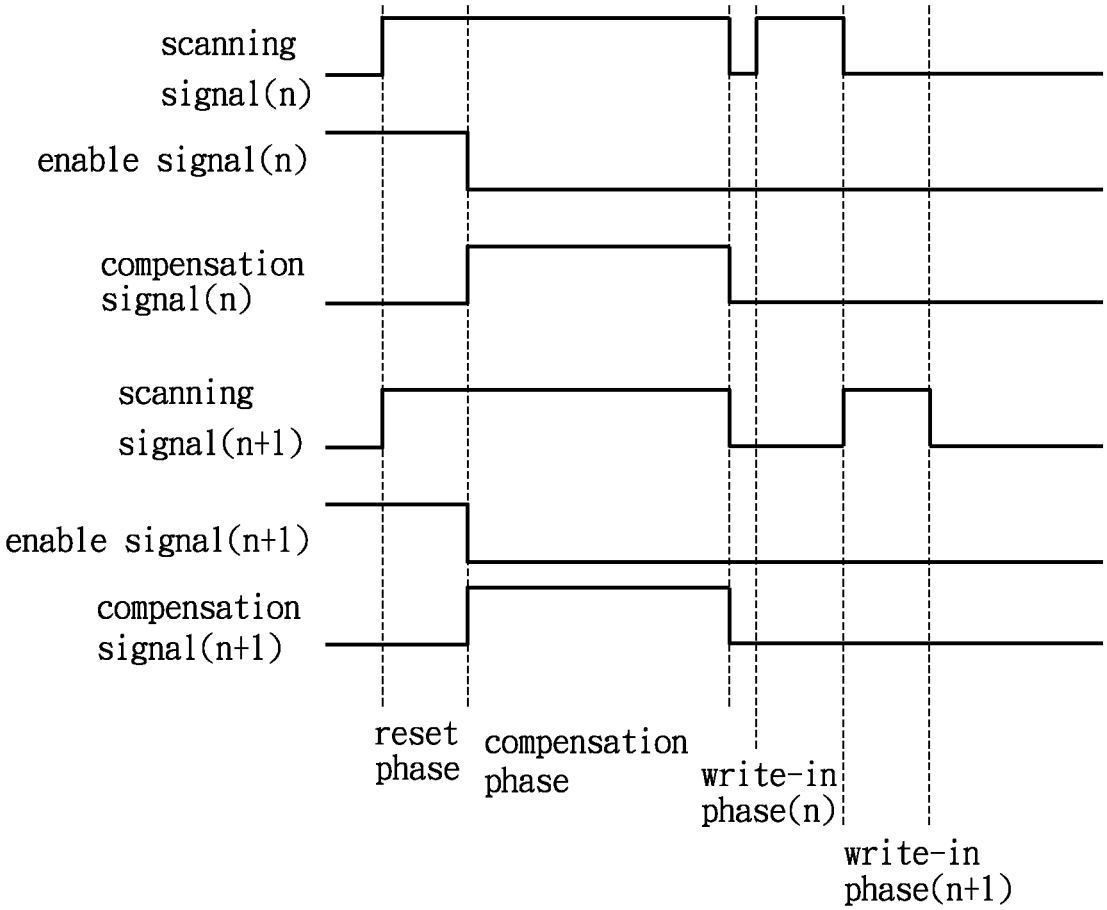

With further reference to FIG. 5, while a display device including the pixel circuits of the first preferred embodiment is performing column-by-column scanning, the pixel circuits in different columns may be operated simultaneously in the reset phase, be operated simultaneously in the compensation phase, and be operated sequentially in the write-in phase. However, in a modification, the pixel circuits in different columns may be operated sequentially in the reset phase, and be operated sequentially in the compensation phase.

Figure 6:
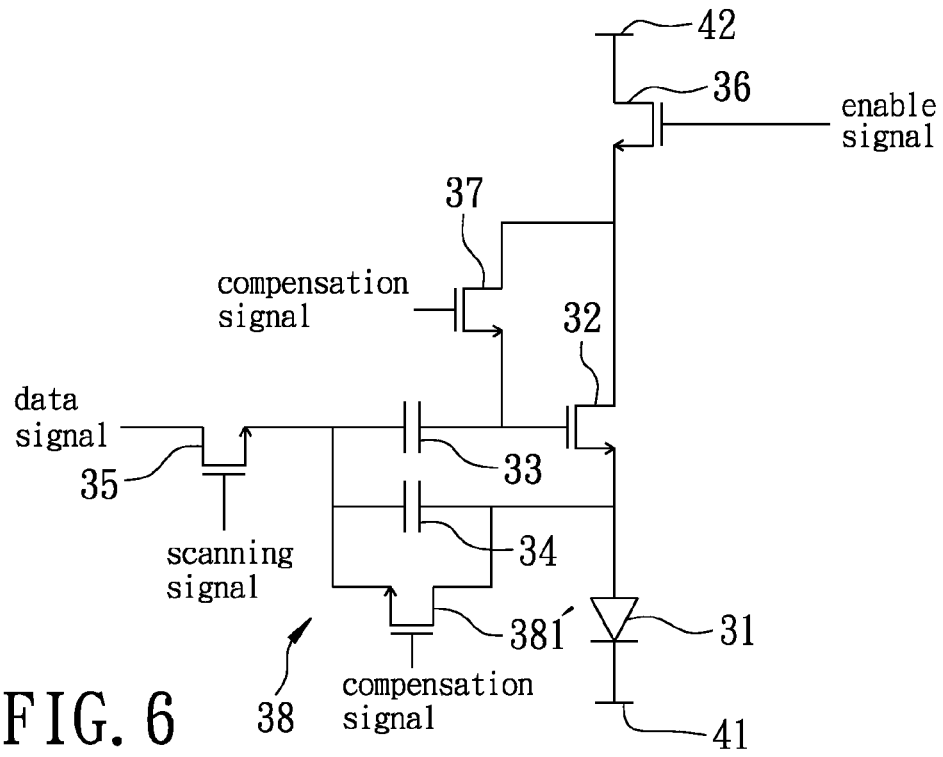
FIGS. 6 to 8 are schematic circuit diagrams of the second to fourth preferred embodiments of a pixel circuit for an OLED-based display device according to the present invention.

FIG. 6 illustrates the second preferred embodiment of a pixel circuit according to this invention. The second preferred embodiment differs from the first preferred embodiment in that, in the second preferred embodiment, the first and second terminals of the fourth switch 381' of the switching unit 38 are connected electrically and respectively to the second terminal of the transistor 32 and the first terminal of the first capacitor 33. In such a configuration, the fourth switch 381' permits transmission of the voltage at the first terminal of the first capacitor 33 therethrough to the second terminal of the transistor 32 when the switching unit 38 is operated in the conductive state, and the fourth switch 381' prevents transmission of the voltage at the first terminal of the first capacitor 33 therethrough to the second terminal of the transistor 32 when the switching unit 38 is operated in the non-conductive state.

Moreover, in the second preferred embodiment, the reset voltage "$V_{RST}$" corresponds substantially in magnitude to the logic low voltage "$V_L$".

Figure 7:
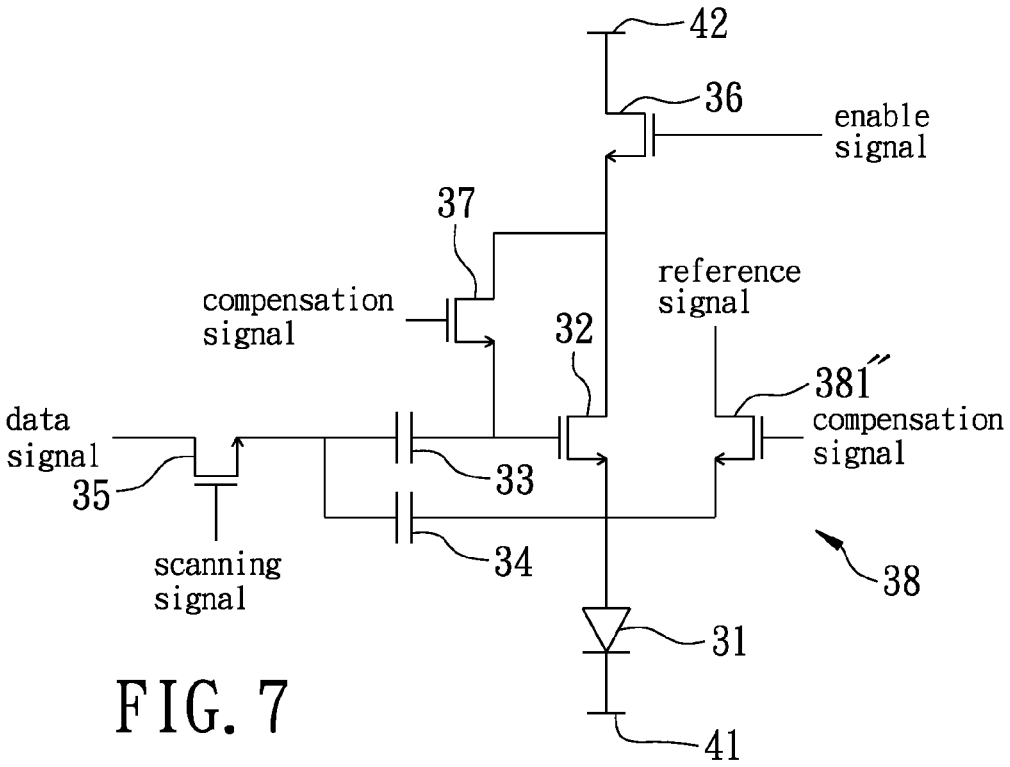

FIG. 7 illustrates the third preferred embodiment of a pixel circuit according to this invention. The third preferred embodiment differs from the first preferred embodiment in that, in the third preferred embodiment, the first terminal of the fourth switch 381" is disposed to receive the reference signal, which is at the logic low voltage "$V_L$", instead of the enable signal. In such a configuration, the fourth switch 381" permits transmission of the reference signal therethrough to the second terminal of the transistor when the switching unit 38 is operated in the conductive state, and prevents transmission of the reference signal therethrough to the second terminal of the transistor 32 when the switching unit 38 is operated in the non-conductive state.

Figure 8:
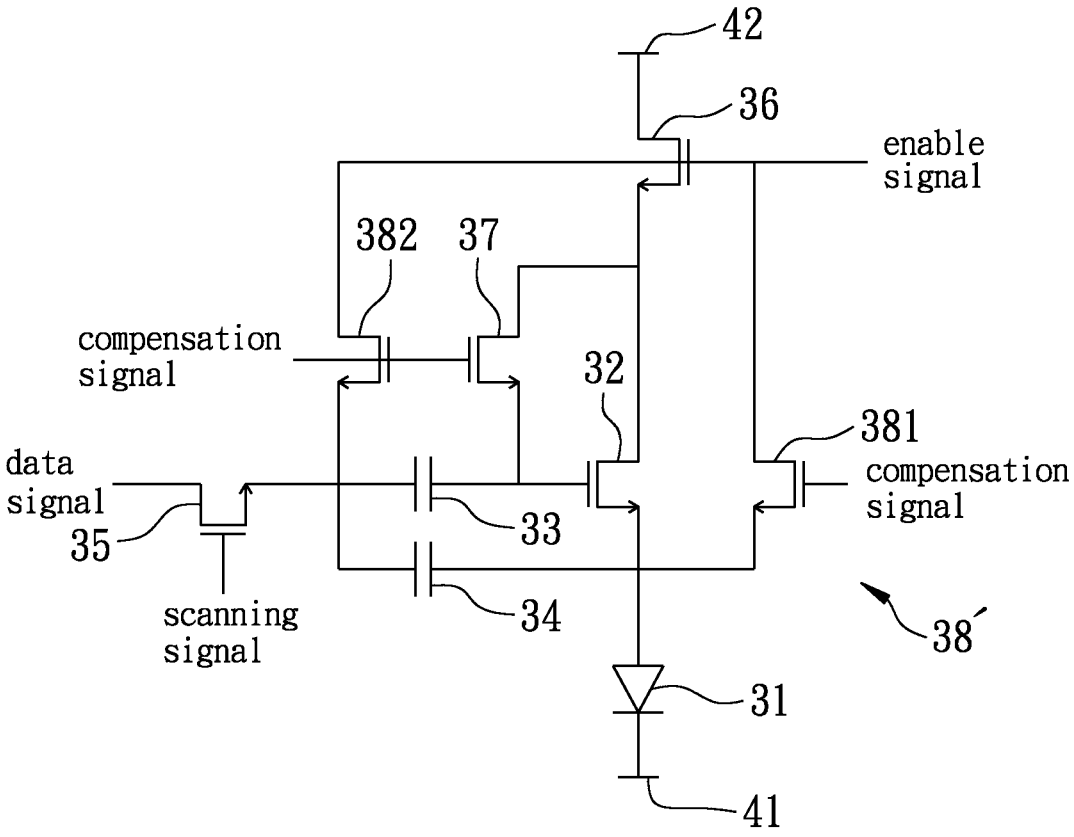

FIG. 8 illustrates the fourth preferred embodiment of a pixel circuit according to this invention. The fourth preferred embodiment differs from the first preferred embodiment in that, in the fourth preferred embodiment, the switching unit 38' further includes a fifth switch 382 having a first terminal disposed to receive the enable signal, a second terminal connected electrically to the first terminal of the first capacitor 33, and a control terminal disposed to receive the compensation signal. In such a configuration, the fifth switch 382 permits transmission of the enable signal therethrough to the first terminal of the first capacitor 33 when the switching unit 38 is operated in the conductive state, and prevents transmission of the enable voltage therethrough to the first terminal of the first capacitor 33 when the switching unit 38 is operated in the non-conductive state. In this embodiment, the fifth switch 382 is an n-type TFT.

Figure 9:
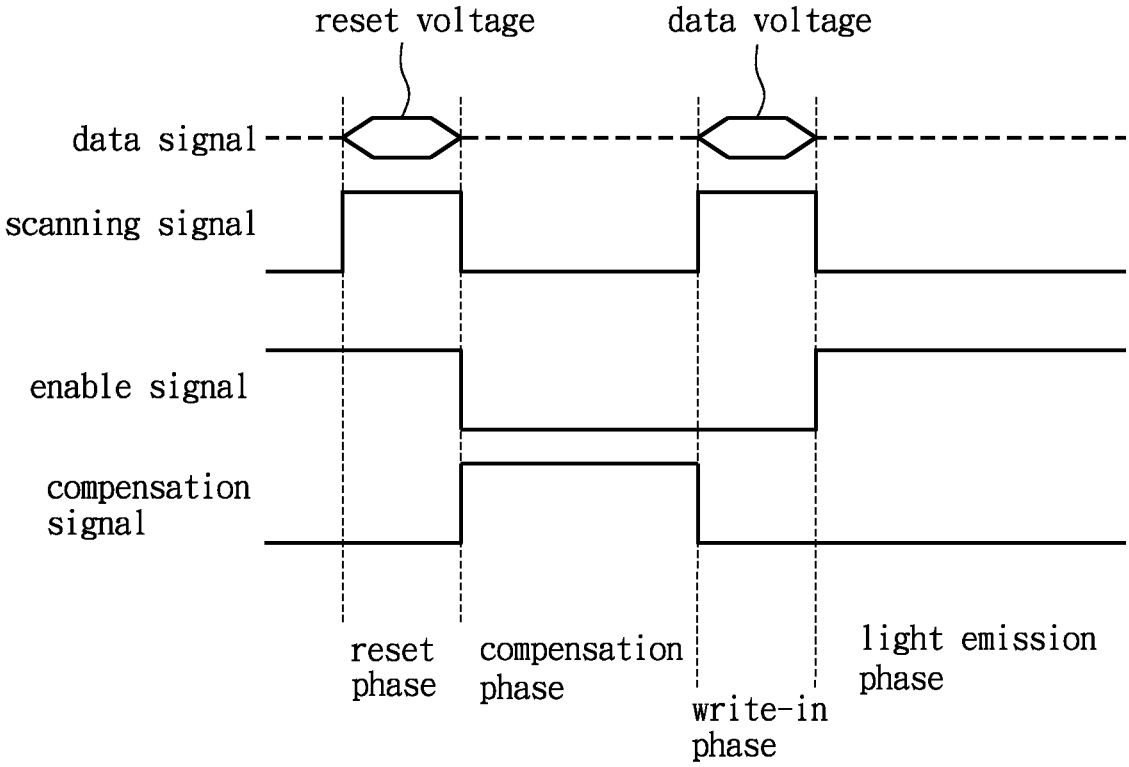
FIGS. 9 to 11 are timing diagrams of the fourth preferred embodiment.

Further referring to FIG. 9, operation of the pixel circuit of the fourth preferred embodiment may be divided into a reset phase, a compensation phase, a write-in phase, and an light-emission phase.

In the reset phase, the data signal is at the reset voltage "$V_{RST}$", the scanning signal is at the logic high voltage "$V_H$", the enable signal is at the logic high voltage "$V_H$", the compensation signal is at the logic low voltage "$V_L$", the OLED 31 is in the non-conductive state, the transistor 32 is in the non-conductive state, the first switch 35 is in the conductive state, the second switch 36 is in the conductive state, the third switch 37 is in the non-conductive state, the fourth switch 381 of the switching unit 38' is in the non-conductive state, and the fifth switch 382 of the switching unit 38' is in a non-conductive state.

Thus, the voltage "$V_{DD}$" at the second power terminal 42 is transmitted through the second switch 36 to the first terminal of the transistor 32. The data signal is transmitted through the first switch 35 and coupled through the first capacitor 33 to the control terminal of the transistor 32, such that the voltage at the first terminal of the first capacitor 33 corresponds to the reset voltage "$V_{RST}$". The voltage at the control terminal of the transistor 32 corresponds to a sum of the reset voltage "$V_{RST}$" and the threshold voltage "$V_T$" (i.e., $V_{RST}+V_T$). It is to be noted that the cross-voltage of the first capacitor 33 corresponds to the threshold voltage "$V_T$" of the transistor 32 due to the previous phase.

The transistor 32 is in the non-conductive state when the pixel circuit satisfies the relationship of $$(V_{RST}+V_T)-[V_{SS}+V_{OLED}(0)]<V_T \Rightarrow V_{RST}<V_{SS}+V_{OLED}(0)$$

where "$V_{SS}$" represents the voltage at the first power terminal 41, and "$V_{OLED}(0)$" represents a threshold voltage of the OLED 31.

In the compensation phase, the scanning signal is at the logic low voltage "$V_L$", the enable signal is at the logic low voltage "$V_L$", the compensation signal is at the logic high voltage "$V_H$", the OLED 31 is in the non-conductive state, the transistor 32 switches from the conductive state to the non-conductive state, the first switch 35 is in the non-conductive state, the second switch 36 is in the non-conductive state, the third switch 37 is in the conductive state, the fourth switch 381 of the switching unit 38' is in the conductive state, and the fifth switch 382 of the switching unit 38' is in a conductive state.

The enable signal is transmitted through the fifth switch 382 to the first terminal of the first capacitor 33, and through the fourth switch 381 to the second terminal of the transistor 32, such that the voltage at the first terminal of the first capacitor 33 corresponds to the logic low voltage "$V_L$", and that the voltage at the second terminal of the transistor 32 corresponds to the logic low voltage "$V_L$". The third switch 37 is in the conductive state, causing the transistor 32 to switch to the conductive state due to an increase in the voltage at the control terminal thereof, and causing the voltages at the first terminal and the control terminal of the transistor 32 to reduce to a sum of the logic low voltage "$V_L$" and the threshold voltage "$V_T$" (i.e., $V_L+V_T$), which subsequently cause the transistor 32 to switch to the non-conductive state.

In the write-in phase, the data signal is at the data voltage "$V_{DATA}$", the scanning signal is at the logic high voltage "$V_H$", the enable signal is at the logic low voltage "$V_L$", the compensation signal is at the logic low voltage "$V_L$", the OLED 31 is in the non-conductive state, the transistor 32 is in the conductive state, the first switch 35 is in the conductive state, the second switch 36 is in the non-conductive state, the third switch 37 is in the non-conductive state, the fourth switch 381 of the switching unit 38' is in the non-conductive state, and the fifth switch 382 of the switching unit 38' is in the non-conductive state.

Thus, the data signal is transmitted through the first switch 35 and coupled respectively through the first capacitor 33 and the second capacitor 34 to the control terminal and the second terminal of the transistor 32, such that the voltage at the first terminal of the first capacitor 33 corresponds to the data voltage "$V_{DATA}$", that the voltage at the control terminal of the transistor 32 corresponds to a sum of the data voltage "$V_{DATA}$" and the threshold voltage "$V_T$" of the transistor 32 (i.e., $V_{DATA}+V_T$), and that the voltage at the second terminal of the transistor 32 corresponds to a result of $(V_L+(V_{DATA}-V_L)f_1)$, where "$f_1$" corresponds to $(C_2/(C_2+C_{P1}))$, "$C_2$" represents a capacitance value of the second capacitor 34, and "$C_{P1}$" represents a capacitance value of a parasitic capacitor associated with the second terminal of the transistor 32.

The OLED 31 is in the non-conductive state and the transistor 32 is in the conductive state when the pixel circuit satisfies the relationships of $$V_L+(V_{DATA}-V_L)f_1<V_{SS}+V_{OLED}(0) \Rightarrow f_1<\frac{V_{SS}+V_{OLED}(0)-V_L}{V_{DATA}-V_L},$$

and $$(V_{DATA}+V_T)-[V_L+(V_{DATA}-V_L)f_1]>V_T \Rightarrow V_{DATA}-V_L>0$$

In the light-emission phase, the scanning signal is at the logic low voltage "$V_L$", the enable signal is at the logic high voltage "$V_H$", the compensation signal is at the logic low voltage "$V_L$", the OLED 31 is in the conductive state, the transistor 32 is in the conductive state, the first switch 35 is in the non-conductive state, the second switch 36 is in the conductive state, the third switch 37 is in the non-conductive state, the fourth switch 381 of the switching unit 38' is in the non-conductive state, and the fifth switch 382 of the switching unit 38' is in the non-conductive state.

Thus, the first terminal of the first capacitor 33 is in a floating state, the voltage "$V_{OLED_A}$" at the second terminal of the transistor 32 is related to the OLED 31, and is coupled through the second capacitor 34 to the control terminal of the transistor 32, such that the voltage "$V_G$" at the control terminal of the transistor 32 satisfies the relationship of $$\begin{aligned} V_G &= (V_{DATA}+V_T)+\lfloor V_{OLED_A}-V_L-(V_{DATA}-V_L)f_1\rfloor f_2 \\ &= V_{DATA}(1-f_3)+V_L(f_3-f_2)+V_{OLED_A}f_2+V_T \end{aligned}$$

where "$f_2$" corresponds to $C_2/(C_2+C_{P2})$, "$C_{P2}$" is a capacitance value of a parasitic capacitor associated with the first terminal of the first capacitor 33, and "$f_3$" corresponds to a result of product of "$f_1$" and "$f_2$".

The driving current "$I_{DRIVE}$" generated by the transistor 32 satisfies the relationship of $$I_{DRIVE} = \frac{1}{2}\mu C_{OX}\frac{W}{L}[V_{DATA}(1 - f_3) + V_L(f_3 - f_2) + V_{OLED_A}(f_2 - 1)]^2$$

It can be understood from at least the aforementioned relationships that the driving current "$I_{DRIVE}$" and the threshold voltage "$V_T$" of the transistor 32 are unrelated to each other. Therefore, the pixel circuit of the fourth preferred embodiment is capable of alleviating influence of changes in the threshold voltage "$V_T$" upon the driving current "$I_{DRIVE}$".

In addition, the pixel circuit of the fourth preferred embodiment receives fewer signals in comparison with the conventional pixel circuit. Thus, the pixel circuit of the fourth preferred embodiment occupies a relatively small circuit layout area, which is favorable for increasing area of light emission.

Figure 10:
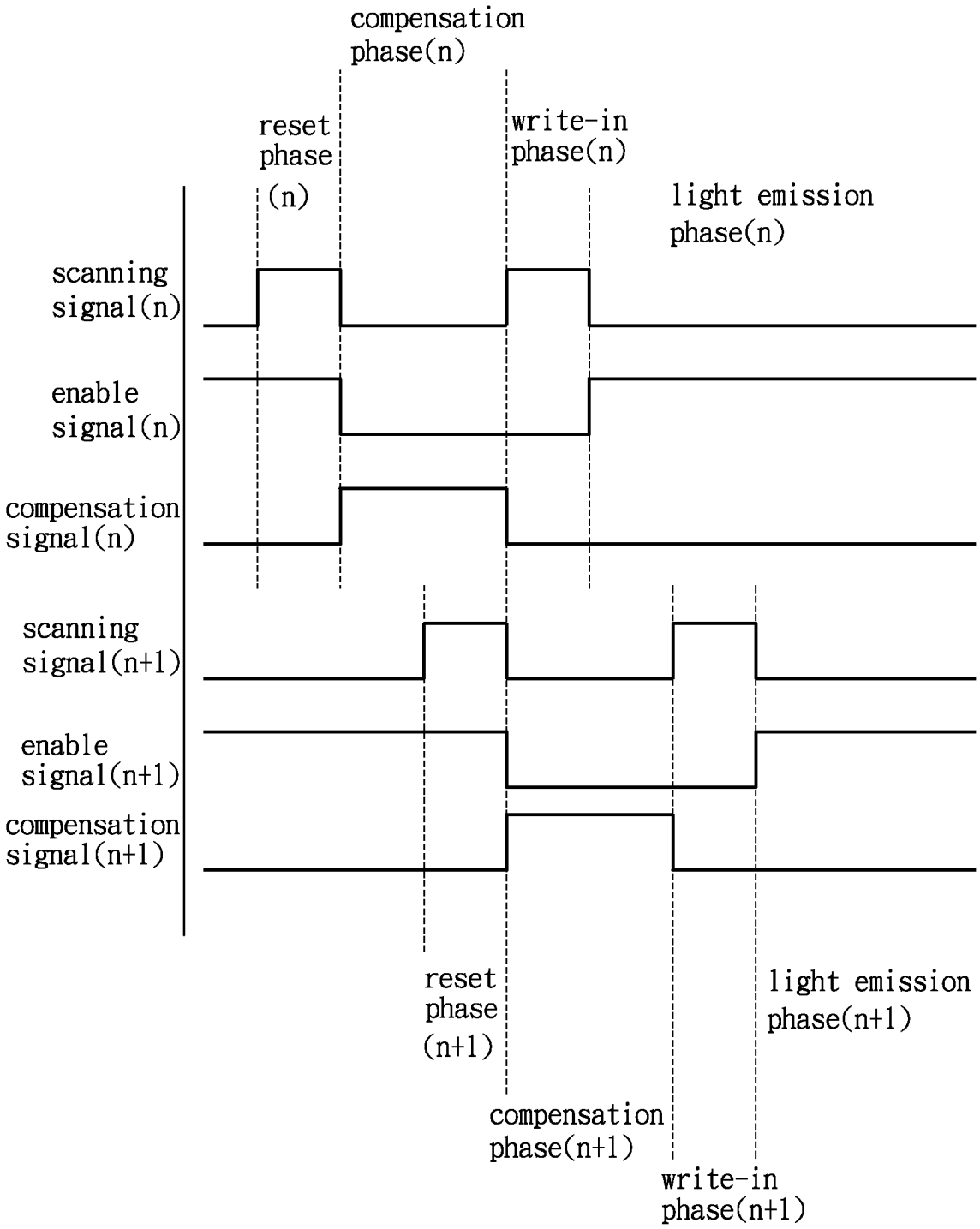

While a display device including the pixel circuits of the fourth preferred embodiment is performing column-by-column scanning, the enable signal and the compensation signal received by the pixel circuits in one column may either be different from (see FIG. 10) or the same as (see FIG. 11) those received by the pixel circuits in another column, the configuration of which may require a relatively small circuit layout area and may achieve increasing area of light emission. Furthermore, the pixel circuits in one column may be operated in an operational phase (e.g., the compensation phase) different from that (e.g., the reset phase or the write-in phase) in which the pixel circuits in another column are operated.

Figure 11:
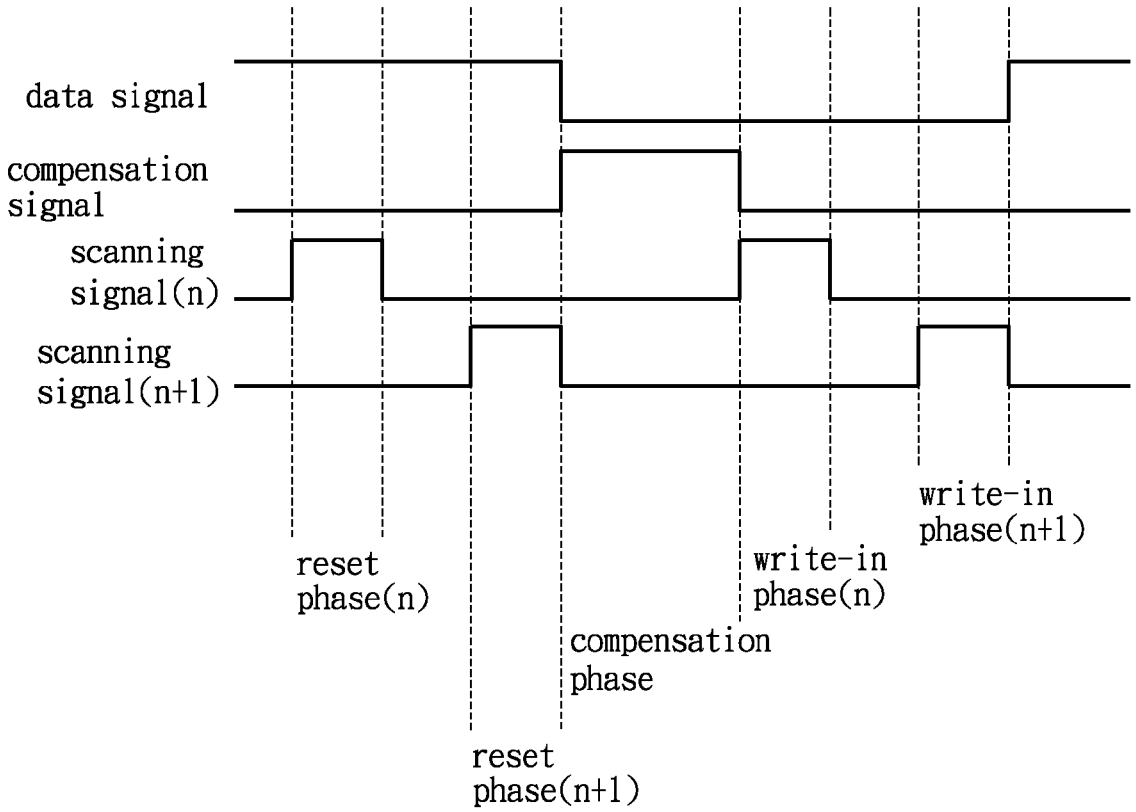

Moreover, while the display device is performing column-by-column scanning, the pixel circuits in different columns may be operated sequentially in the reset phase, be operated simultaneously in the compensation phase, and be operated sequentially in the write-in phase (see FIG. 11). However, in a modification, the pixel circuits in different columns may be operated simultaneously in the reset phase, be operated simultaneously in the compensation phase, and be operated sequentially in the write-in phase.

Figure 12:
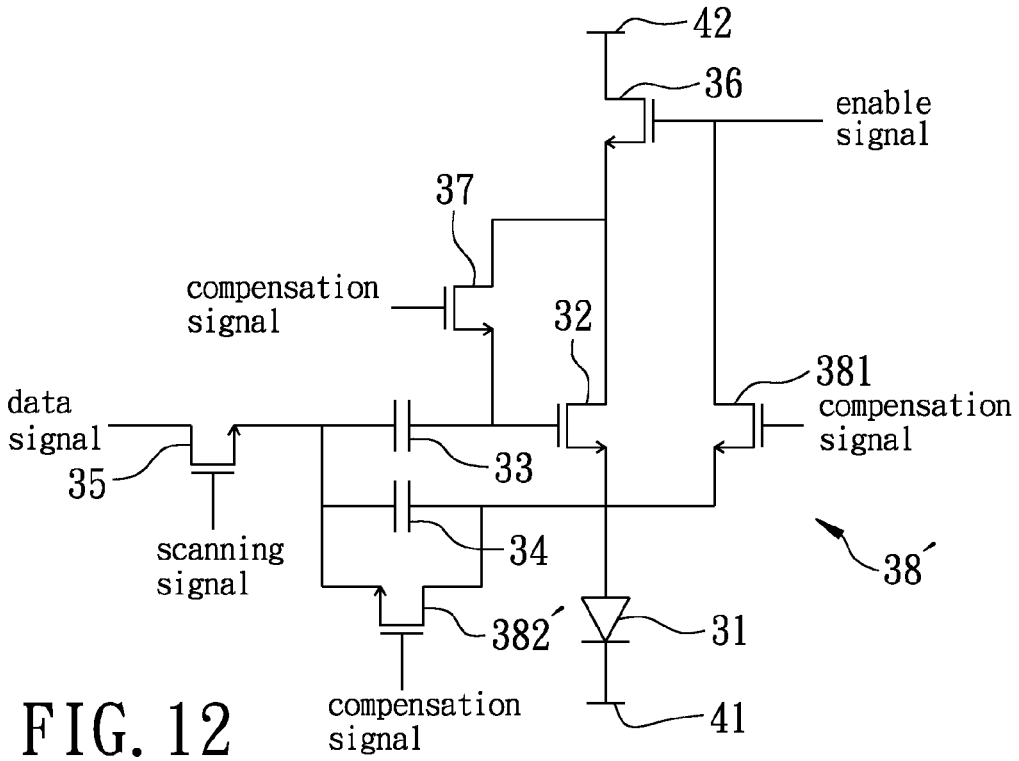
FIGS. 12 to 25 are schematic circuit diagrams of the fifth to eighteenth preferred embodiments of a pixel circuit for an OLED-based display device according to the present invention.

FIG. 12 illustrates the fifth preferred embodiment of a pixel circuit according to this invention. The fifth preferred embodiment differs from the fourth preferred embodiment in that the first and second terminals of the fifth switch 382' is connected electrically and respectively to the second terminal of the transistor 32 and the first terminal of the first capacitor 33. In such a configuration, the fifth switch 382' permits transmission of the voltage at the second terminal of the transistor 32 therethrough to the first terminal of the first capacitor 33 when the switching unit 38 is operated in the conductive state, and prevents transmission of the voltage at the second terminal of the transistor 32 therethrough to the first terminal of the first capacitor 33 when the switching unit 38 is operated in the non-conductive state.

Figure 13:
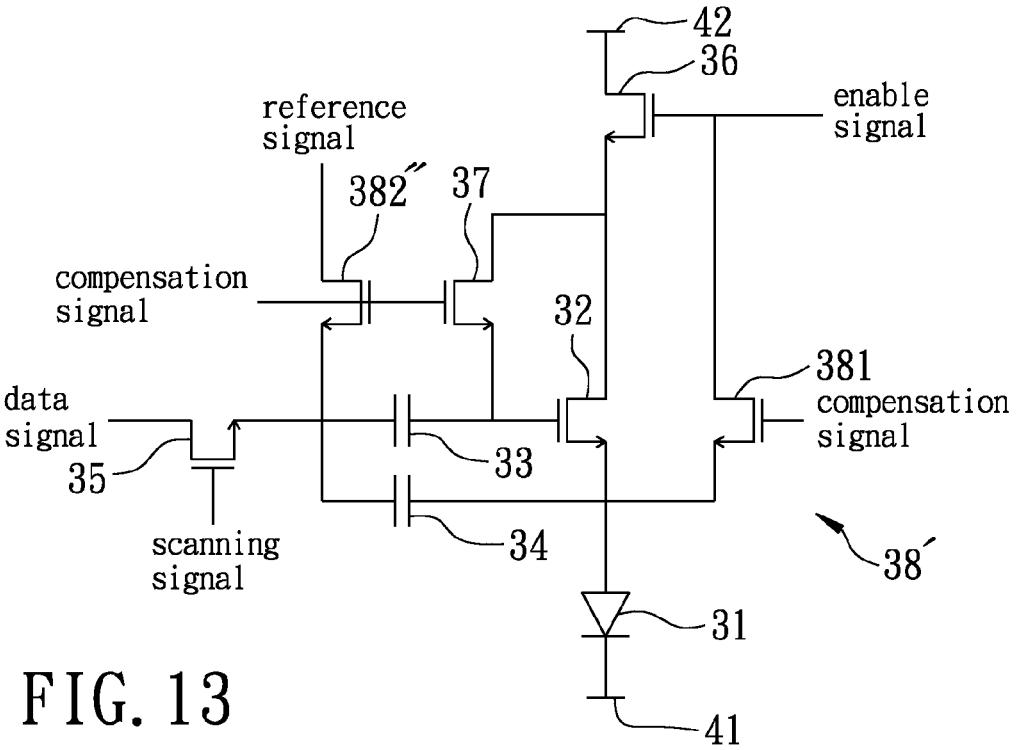

FIG. 13 illustrates the sixth preferred embodiment of a pixel circuit according to this invention. The sixth preferred embodiment differs from the fourth preferred embodiment in that, in the sixth preferred embodiment, the first terminal of the fifth switch 382" is disposed to receive the reference signal. In such a configuration, the fifth switch 382" permits transmission of the reference signal, which is the logic low voltage "$V_L$", therethrough to the first terminal of the first capacitor 33 when the switching unit 38 is operated in the conductive state, and prevents transmission of the reference signal therethrough to the first terminal of the first capacitor 33 when the switching unit 38 is operated in the non-conductive state.

Figure 14:
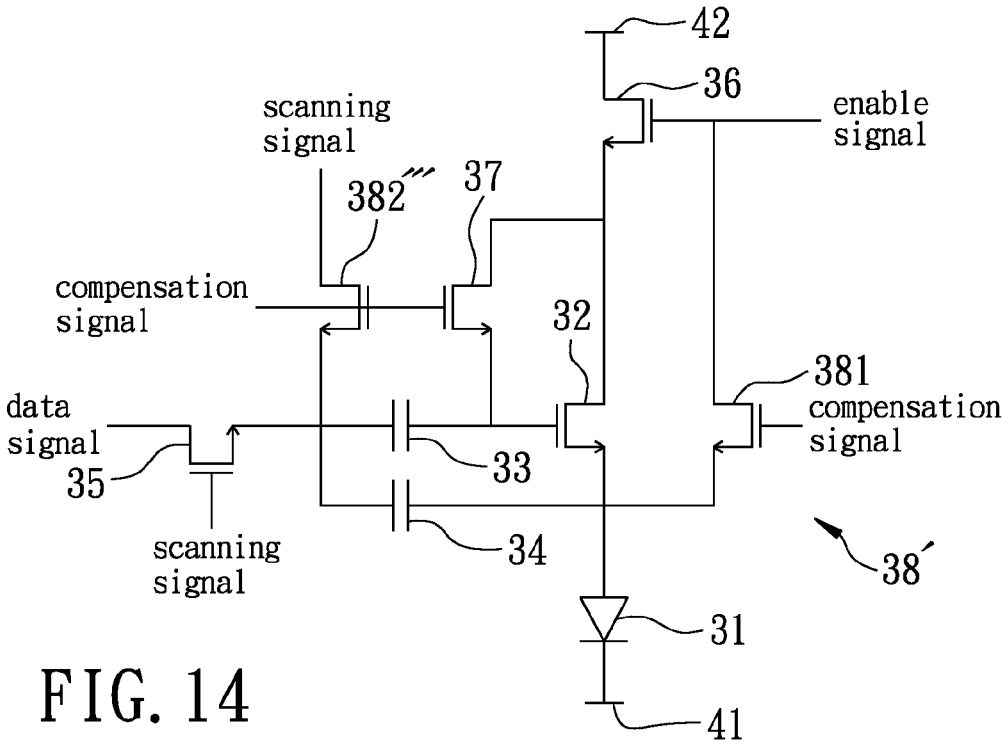

FIG. 14 illustrates the seventh preferred embodiment of a pixel circuit according to this invention. The seventh preferred embodiment differs from the fourth preferred embodiment in that, in the seventh preferred embodiment, the first terminal of the fifth switch 382''' is disposed to receive the scanning signal. In such a configuration, the fifth switch 382'''permits transmission of the scanning signal therethrough to the first terminal of the first capacitor 33 when the switching unit 38 is operated in the conductive state, and prevents transmission of the scanning signal therethrough to the first terminal of the first capacitor 33 when the switching unit 38 is operated in the non-conductive state.

Figure 15:
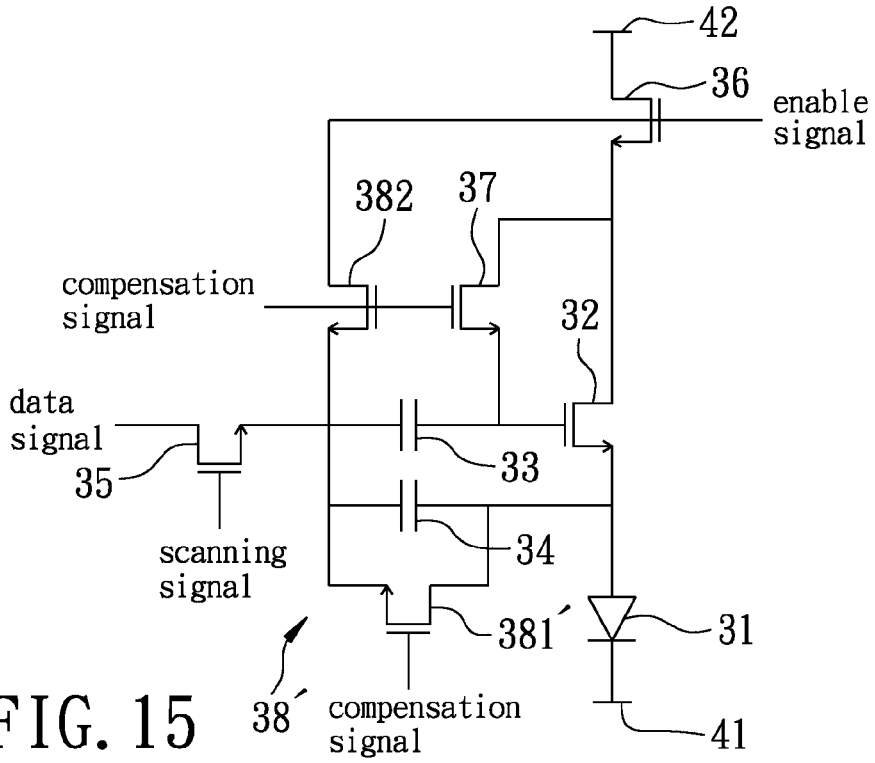

FIG. 15 illustrates the eighth preferred embodiment of a pixel circuit according to this invention. The eighth preferred embodiment differs from the fourth preferred embodiment in that, in the eighth preferred embodiment, the first and second terminals of the fourth switch 381' are connected electrically and respectively to the first terminal of the first capacitor 33 and the second terminal of the transistor 32. In such a configuration, the fourth switch 381' permits transmission of the voltage at the first terminal of the first capacitor 33 therethrough to the second terminal of the transistor 32 when the switching unit 38 is operated in the conductive state, and prevents transmission of the voltage at the first terminal of the first capacitor 33 therethrough to the second terminal of the transistor 32 when the switching unit 38 is operated in the non-conductive state.

Figure 16:
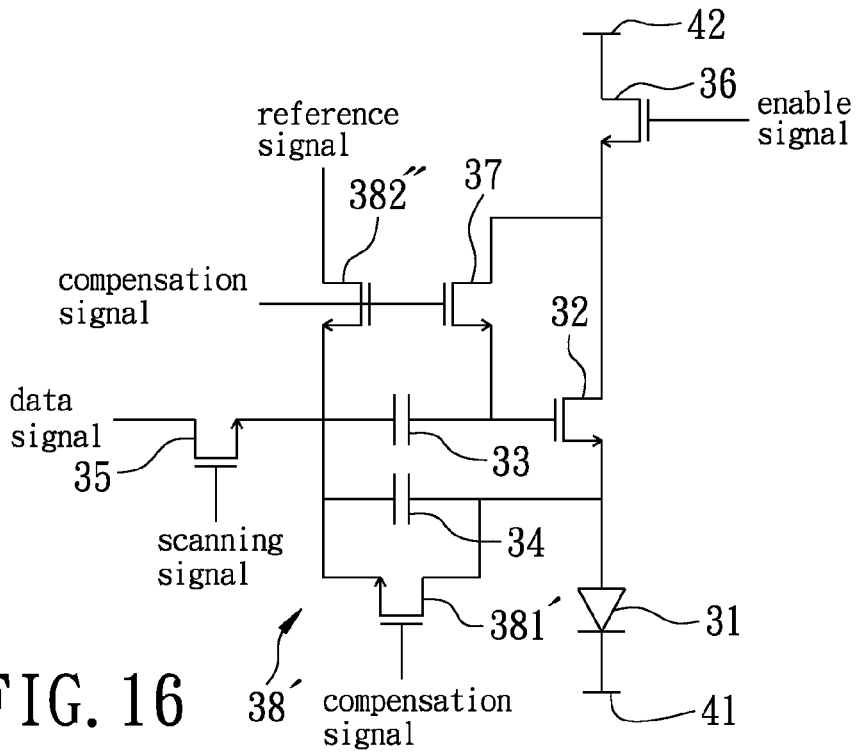

FIG. 16 illustrates the ninth preferred embodiment of a pixel circuit according to this invention. The ninth preferred embodiment differs from the eighth preferred embodiment in that, in the ninth preferred embodiment, the first terminal of the fifth switch 382" is disposed to receive the reference signal instead of the enable signal. In such a configuration, the fifth switch 382" permits transmission of the reference signal, which is at the logic low voltage "$V_L$", therethrough to the first terminal of the first capacitor 33 when the switching unit 38 is operated in the conductive state, and prevents transmission of the reference signal therethrough to the first terminal of the first capacitor 33 when the switching unit 38 is operated in the non-conductive state.

Figure 17:
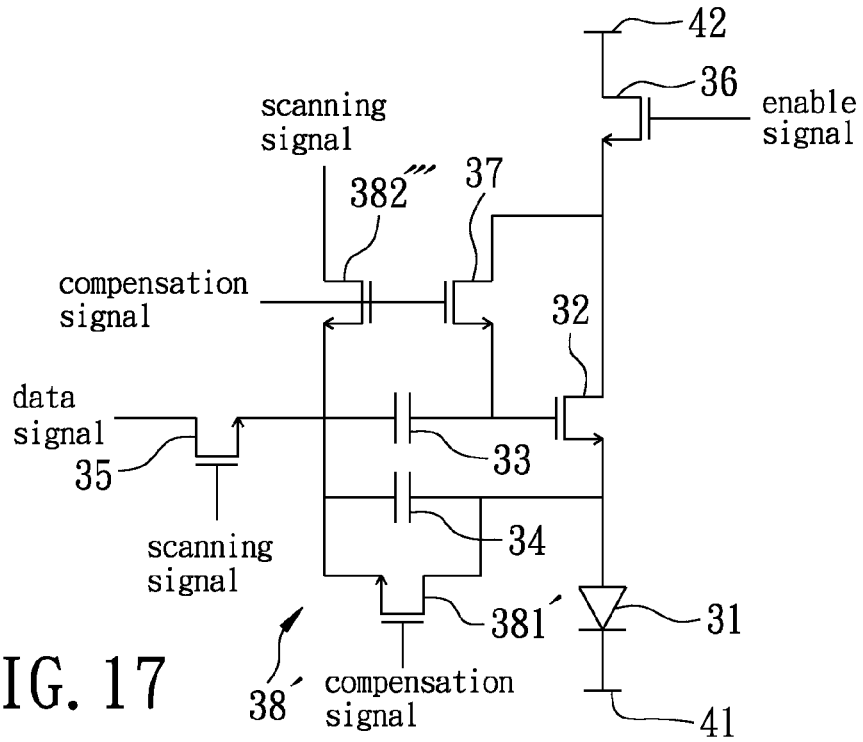

FIG. 17 illustrates the tenth preferred embodiment of a pixel circuit according to this invention. The tenth preferred embodiment differs from the eighth preferred embodiment in that, in the tenth preferred embodiment, the first terminal of the fifth switch 382''' is disposed to receive the scanning signal instead of the enable signal. In such a configuration, the fifth switch 382" permits transmission of the scanning signal therethrough to the first terminal of the first capacitor 33 when the switching unit 38 is operated in the conductive state, and prevents transmission of the scanning signal therethrough to the first terminal of the first capacitor 33 when the switching unit 38 is operated in the non-conductive state.

Figure 18:
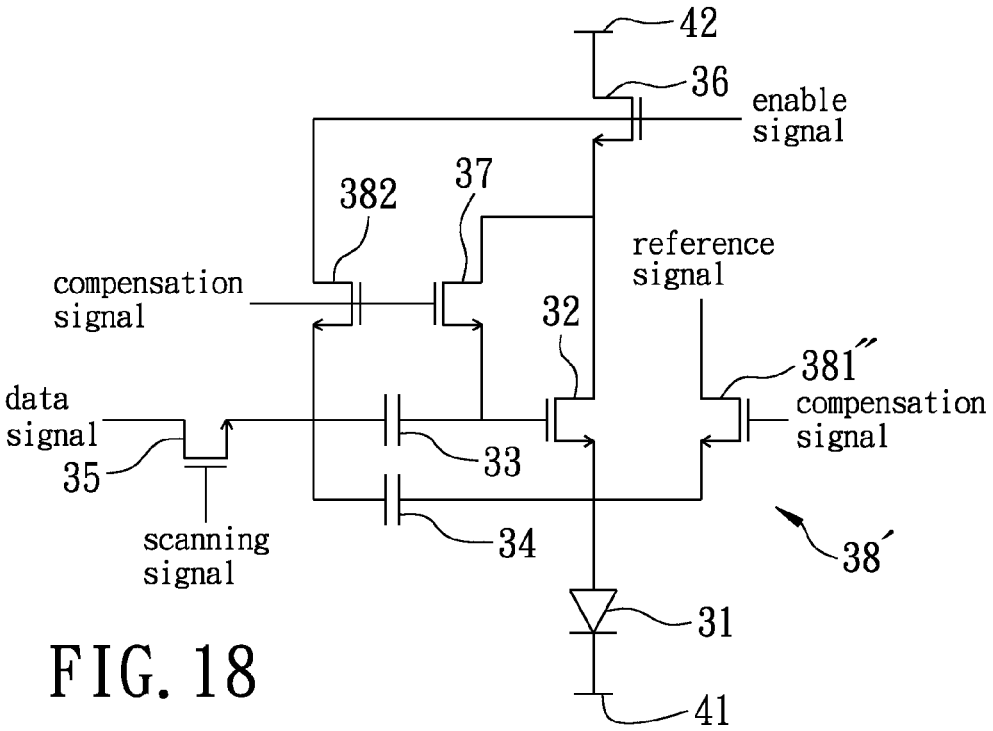

FIG. 18 illustrates the eleventh preferred embodiment of a pixel circuit according to this invention. The eleventh preferred embodiment differs from the fourth preferred embodiment in that, in the eleventh preferred embodiment, the first terminal of the fourth switch 381" is disposed to receive the reference signal instead of the enable signal. In such a configuration, the fourth switch 381" permits transmission of the reference signal, which is at the logic low voltage "$V_L$", therethrough to the second terminal of the transistor 32 when the switching unit 38 is operated in the conductive state, and prevents transmission of the reference signal therethrough to the second terminal of the transistor 32 when the switching unit 38 is operated in the non-conductive state.

Figure 19:
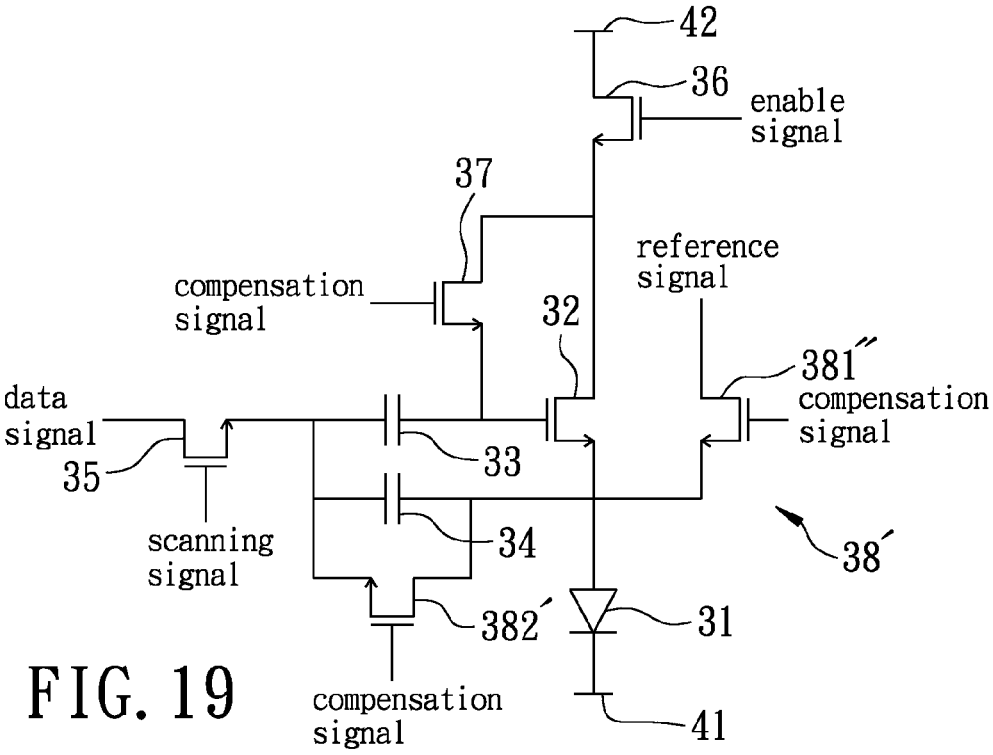

FIG. 19 illustrates the twelfth preferred embodiment of a pixel circuit according to this invention. The twelfth preferred embodiment differs from the eleventh preferred embodiment in that, in the twelfth preferred embodiment, the first and second terminals of the fifth switch 382' are connected electrically and respectively to the first terminal of the first capacitor 33 and the second terminal of the transistor 32. In such a configuration, the fifth switch 382' permits transmission of the voltage at the first terminal of the first capacitor 33 therethrough to the second terminal of the transistor 32 when the switching unit 38 is operated in the conductive state, and prevents transmission of the voltage at the first terminal of the first capacitor 33 therethrough to the second terminal of the transistor 32 when the switching unit 38 is operated in the non-conductive state.

Figure 20:
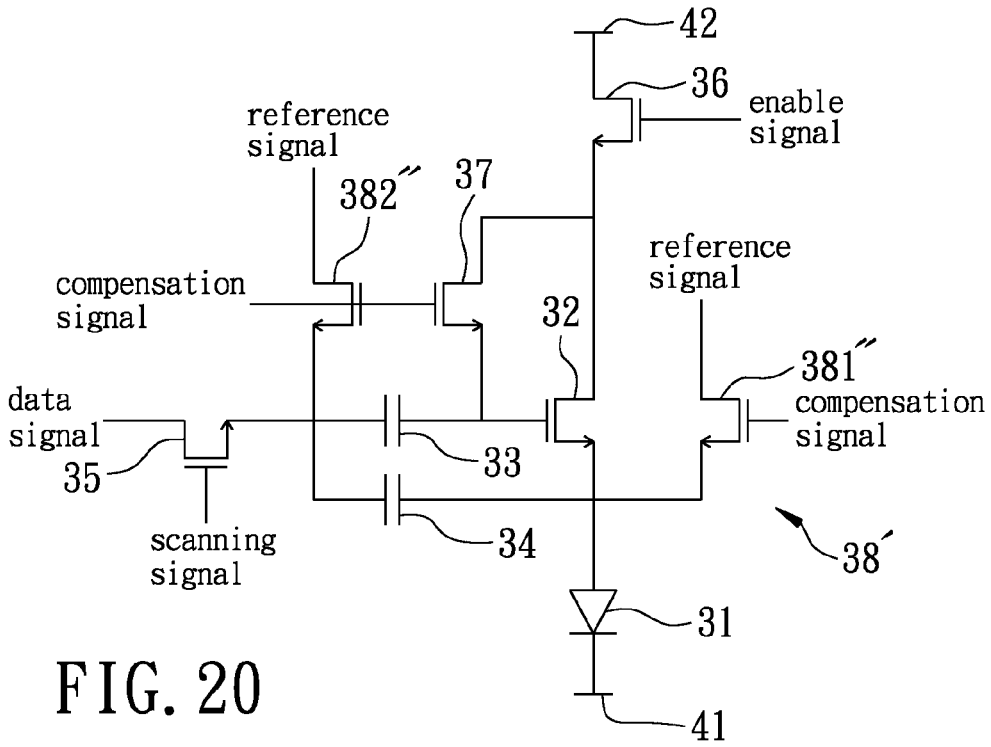

FIG. 20 illustrates the thirteenth preferred embodiment of a pixel circuit according to this invention. The thirteenth preferred embodiment differs from the eleventh preferred embodiment in that, in the thirteenth preferred embodiment, the first terminal of the fifth switch 382" is disposed to receive the reference signal instead of the enable signal. In such a configuration, the fifth switch 382" permits transmission of the reference signal therethrough to the first terminal of the first capacitor 33 when the switching unit 38 is operated in the conductive state, and prevents transmission of the reference signal therethrough to the first terminal of the first capacitor 33 when the switching unit 38 is operated in the non-conductive state.

Figure 21:
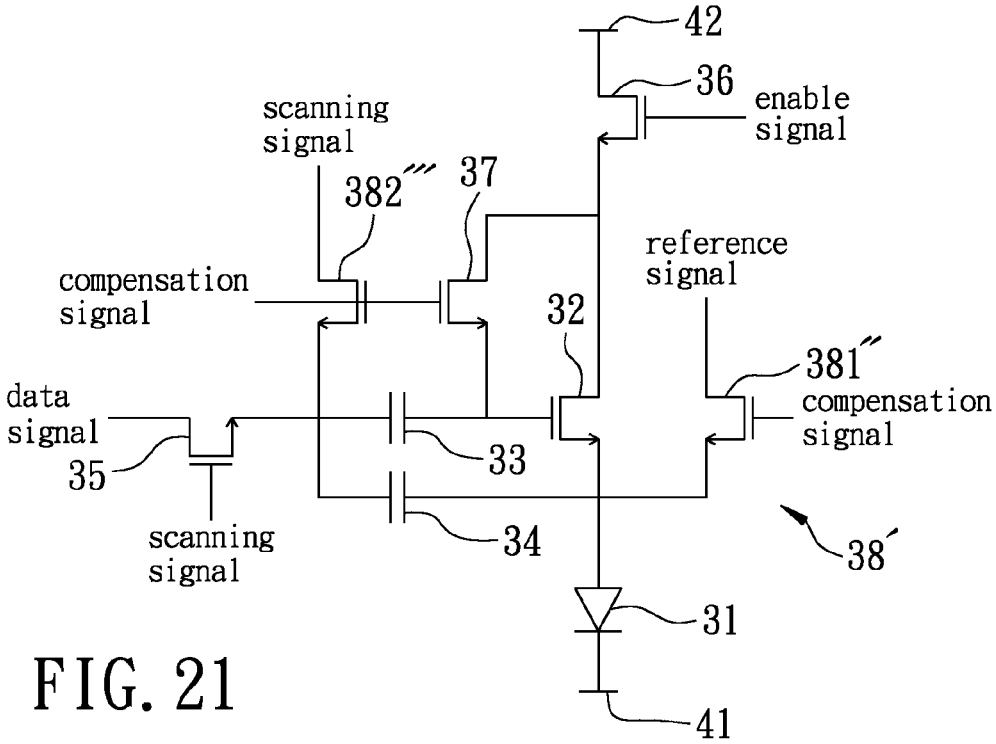

FIG. 21 illustrates the fourteenth preferred embodiment of a pixel circuit according to this invention. The fourteenth preferred embodiment differs from the eleventh preferred embodiment in that, in the fourteenth preferred embodiment, the first terminal of the fifth switch 382'" is disposed to receive the scanning signal instead of the enable signal. In such a configuration, the fifth switch 382'" permits transmission of the scanning signal therethrough to the first terminal of the first capacitor 33 when the switching unit 38 is operated in the conductive state, and prevents transmission of the scanning signal therethrough to the first terminal of the first capacitor 33 when the switching unit 38 is operated in the non-conductive state.

Figure 22:
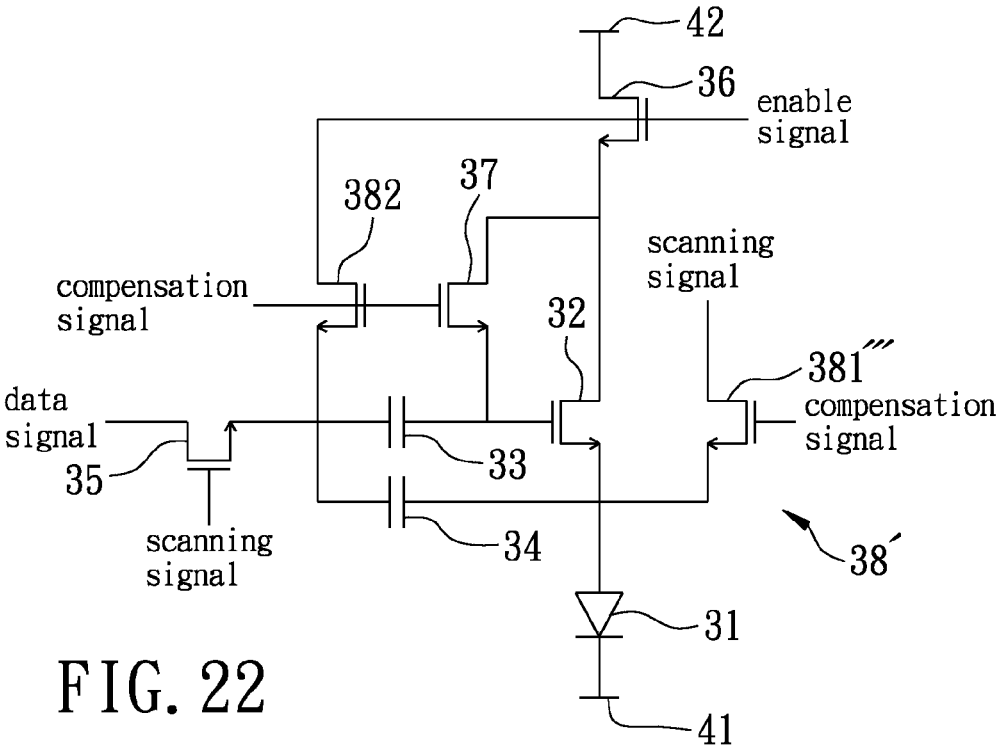

FIG. 22 illustrates the fifteenth preferred embodiment of a pixel circuit according to this invention. The fifteenth preferred embodiment differs from the fourth preferred embodiment in that, in the fifteenth preferred embodiment, the first terminal of the fourth switch 381'" is disposed to receive the scanning signal instead of the enablement signal. In such a configuration, the fourth switch 381'" permits transmission of the scanning signal therethrough to the second terminal of the transistor 32 when the switching unit 38 is operated in the conductive state, and prevents transmission of the scanning signal therethrough to the second terminal of the transistor when the switching unit 38 is operated in the non-conductive state.

Figure 23:
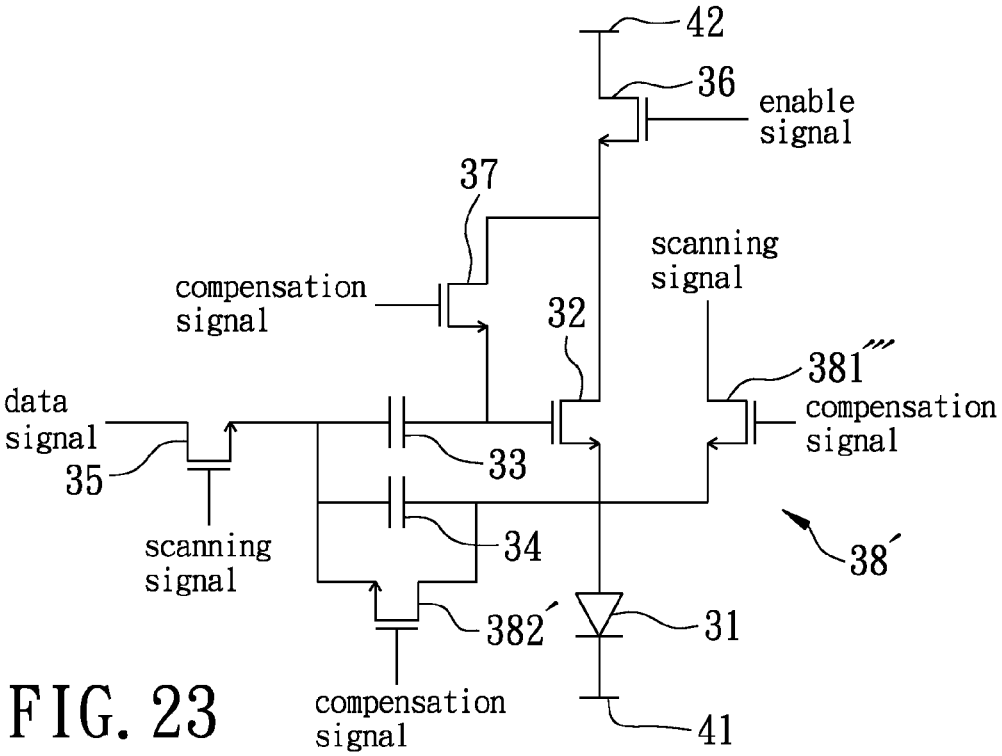

FIG. 23 illustrates the sixteenth preferred embodiment of a pixel circuit according to this invention. The sixteenth preferred embodiment differs from the fifteenth preferred embodiment in that, in the sixteenth preferred embodiment, the first and second terminals of the fifth switch 382' are connected electrically and respectively to the second terminal of the transistor 32 and the first terminal of the first capacitor 33. In such a configuration, the fifth switch 382' permits transmission of the voltage at the second terminal of the transistor 32 therethrough to the first terminal of the first capacitor 33 when the switching unit 38 is operated in the conductive state, and prevents transmission of the voltage at the second terminal of the transistor 32 therethrough to the first terminal of the first capacitor 33 when the switching unit 38 is operated in the non-conductive state.

Figure 24:
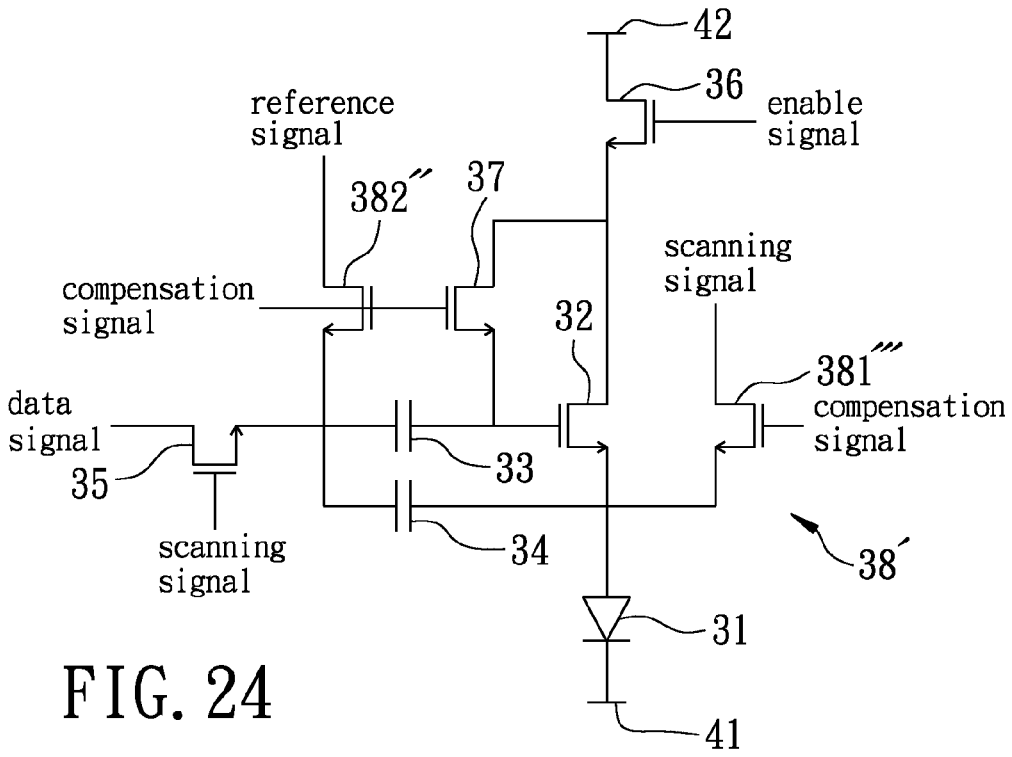

FIG. 24 illustrates the seventeenth preferred embodiment of a pixel circuit according to this invention. The seventeenth preferred embodiment differs from the fifteenth preferred embodiment in that, in the seventeenth preferred embodiment, the first terminal of the fifth switch 382" is disposed to receive the reference signal instead of the enable signal. In such a configuration, the fifth switch 382" permits transmission of the reference signal, which is at the logic low voltage "$V_L$", therethrough to the first terminal of the first capacitor 33 when the switching unit 38 is operated in the conductive state, and prevents transmission of reference signal therethrough to the first terminal of the first capacitor 33 when the switching unit 38 is operated in the non-conductive state.

Figure 25:
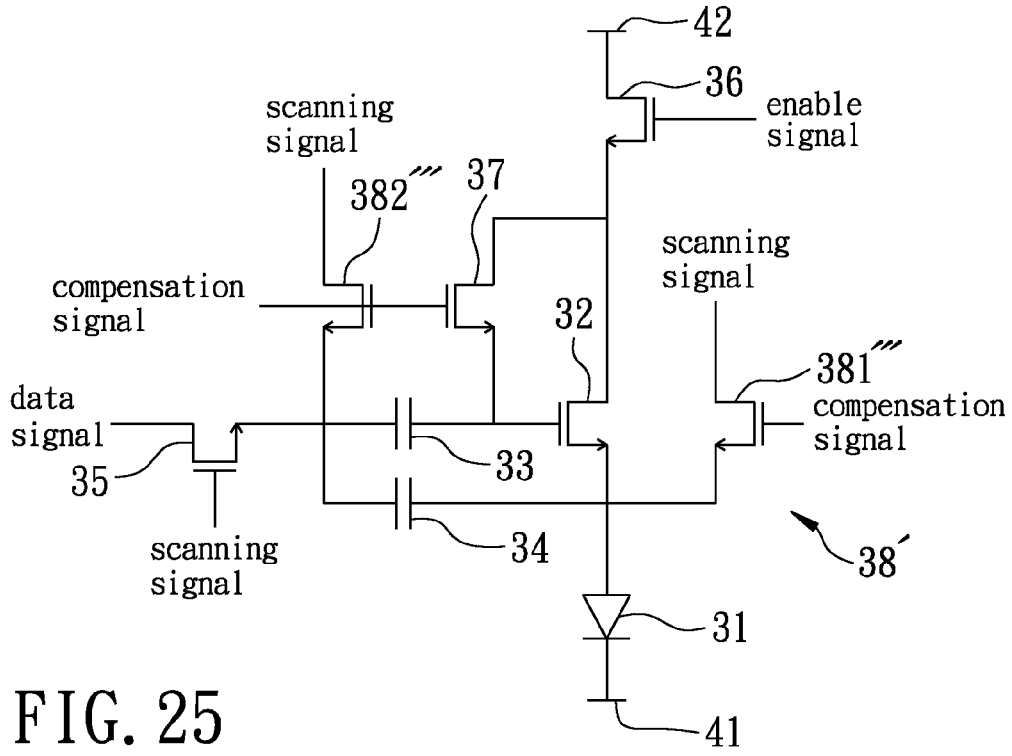

FIG. 25 illustrates the eighteenth preferred embodiment of a pixel circuit according to this invention. The eighteenth preferred embodiment differs from the fifteenth preferred embodiment in that, in the eighteenth preferred embodiment, the first terminal of the fifth switch 382" is disposed to receive the scanning signal instead of the enable signal. In such a configuration, the fifth switch 382" permits transmission of the scanning signal therethrough to the first terminal of the first capacitor 33 when the switching unit 38 is operated in the conductive state, and prevents transmission of scanning signal therethrough to the first terminal of the first capacitor 33 when the switching unit 38 is operated in the non-conductive state.

Figure 26:
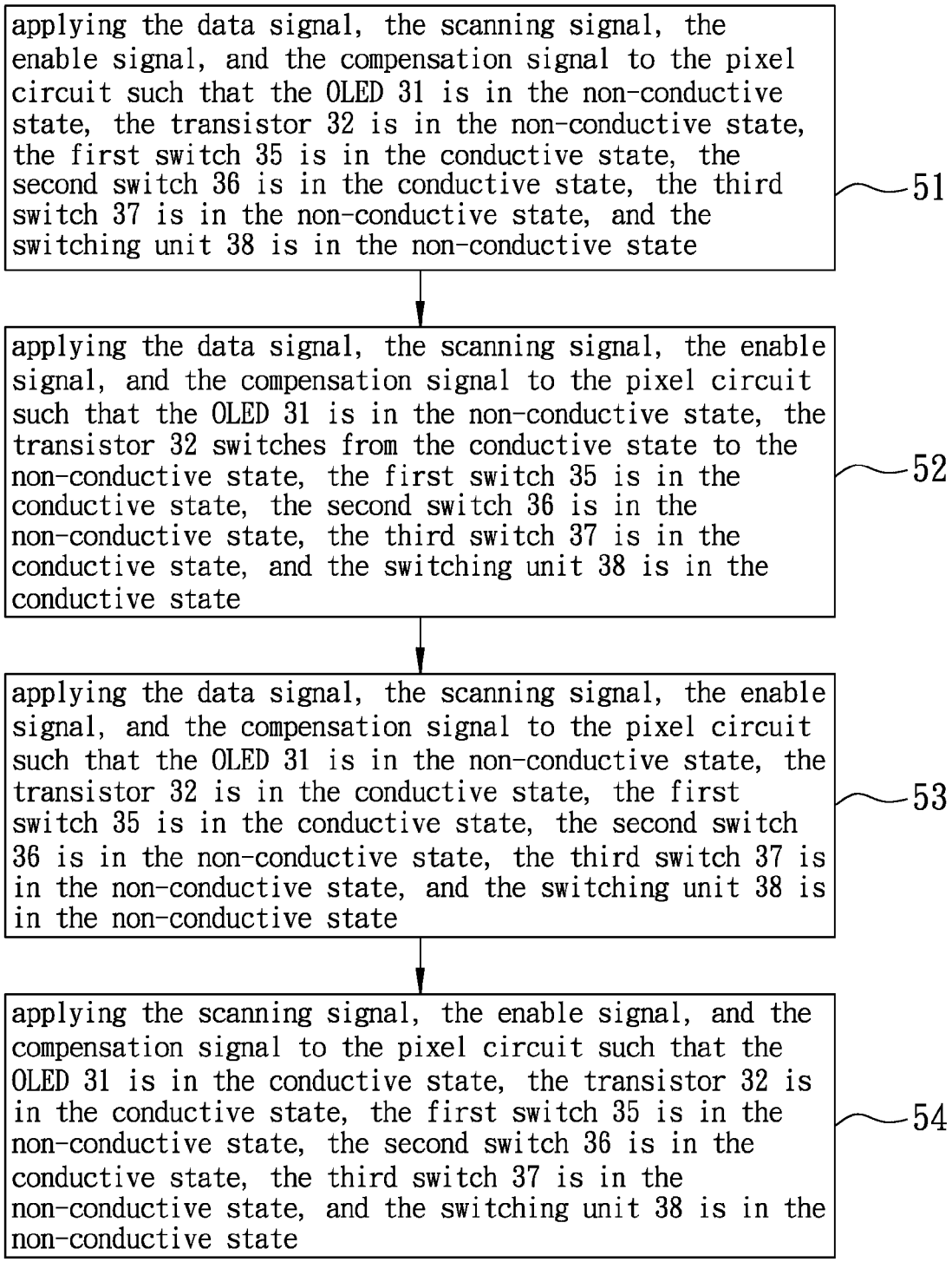
FIG. 26 is a flowchart showing the first preferred embodiment of a driving method according to the present invention.

Referring to FIG. 26, the first preferred embodiment of a driving method of for driving the pixel circuits of the first, second, and third preferred embodiments, according to the present invention, includes steps 51 to 54.

Step 51 includes applying the data signal, the scanning signal, the enable signal, and the compensation signal to the pixel circuit such that the OLED 31 is in the non-conductive state, the transistor 32 is in the non-conductive state, the first switch 35 is in the conductive state, the second switch 36 is in the conductive state, the third switch 37 is in the non-conductive state, and the switching unit 38 is in the non-conductive state.

Step 52 includes applying the data signal, the scanning signal, the enable signal, and the compensation signal to the pixel circuit such that the OLED 31 is in the non-conductive state, the transistor switches from the conductive state to the non-conductive state, the first switch 35 is in the conductive state, the second switch 36 is in the non-conductive state, the third switch 37 is in the conductive state, and the switching unit 38 is in the conductive state.

Step 53 includes applying the data signal, the scanning signal, the enable signal, and the compensation signal to the pixel circuit such that the OLED 31 is in the non-conductive state, the transistor 32 is in the conductive state, the first switch 35 is in the conductive state, the second switch 36 is in the non-conductive state, the third switch 37 is in the non-conductive state, and the switching unit 38 is in the non-conductive state.

Step 54 includes applying the scanning signal, the enable signal, and the compensation signal to the pixel circuit such that the OLED 31 is in the conductive state, the transistor 32 is in the conductive state, the first switch 35 is in the non-conductive state, the second switch 36 is in the conductive state, the third switch 37 is in the non-conductive state, and the switching unit 38 is in the non-conductive state.

Figure 27:
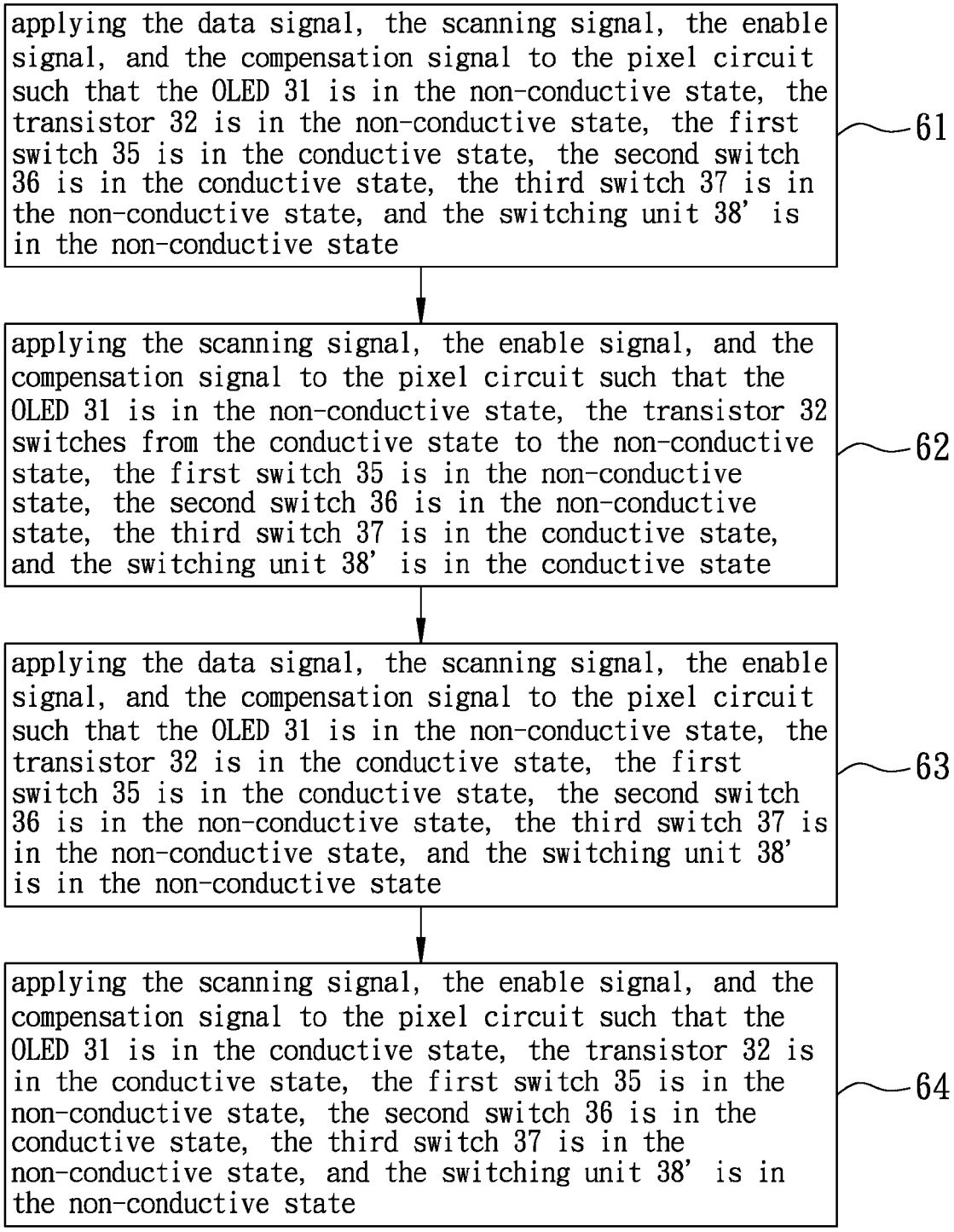
FIG. 27 is a flowchart showing the second preferred embodiment of a driving method according to the present invention.

Referring to FIG. 27, the second preferred embodiment of a driving method for driving the pixel circuits of the fourth to eighteenth preferred embodiments, according to the present invention, includes steps 61 to 64.

Step 61 includes applying the data signal, the scanning signal, the enable signal, and the compensation signal to the pixel circuit such that the OLED 31 is in the non-conductive state, the transistor 32 is in the non-conductive state, the first switch 35 is in the conductive state, the second switch 36 is in the conductive state, the third switch 37 is in the non-conductive state, and the switching unit 38' is in the non-conductive state.

Step 62 includes applying the scanning signal, the enable signal, and the compensation signal to the pixel circuit such that the OLED 31 is in the non-conductive state, the transistor 32 switches from the conductive state to the non-conductive state, the first switch 35 is in the non-conductive state, the second switch 36 is in the non-conductive state, the third switch 37 is in the conductive state, and the switching unit 38' is in the conductive state.

Step 63 includes applying the data signal, the scanning signal, the enable signal, and the compensation signal to the pixel circuit such that the OLED 31 is in the non-conductive state, the transistor 32 is in the conductive state, the first switch 35 is in the conductive state, the second switch 36 is in the non-conductive state, the third switch 37 is in the non-conductive state, and the switching unit 38' is in the non-conductive state.

Step 64 includes applying the scanning signal, the enable signal, and the compensation signal to the pixel circuit such that the OLED 31 is in the conductive state, the transistor 32 is in the conductive state, the first switch 35 is in the non-conductive state, the second switch 36 is in the conductive state, the third switch 37 is in the non-conductive state, and the switching unit 38' is in the non-conductive state.

In summary, since the driving current "$I_{DRIVE}$" flowing through the transistor 32 is unrelated to the threshold voltage "$V_T$" of the transistor 32, the driving current "$I_{DRIVE}$" is not susceptible to influence of changes in the threshold voltage "$V_T$".

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An organic light emitting diode (OLED) based display device comprising a pixel circuit that includes: an organic light emitting diode (OLED) having an anode and a cathode to be connected electrically to a first power terminal; a transistor having a first terminal, a second terminal that is connected electrically to said anode of said OLED, and a control terminal; a first capacitor having a first terminal and a second terminal that is connected electrically to said control terminal of said transistor; a second capacitor having a first terminal that is connected electrically to said first terminal of said first capacitor, and a second terminal that is connected electrically to said second terminal of said transistor; a first switch having a first terminal that is disposed to receive a data signal, a second terminal that is connected electrically to said first terminal of said first capacitor and said first terminal of said second capacitor, and a control terminal that is disposed to receive a scanning signal, said first switch being operable to switch between a conductive state and a non-conductive state according to the scanning signal received by said first switch; a second switch having a first terminal that is to be connected electrically to a second power terminal, a second terminal that is connected electrically to said first terminal of said transistor, and a control terminal that is disposed to receive an enable signal, said second switch being operable to switch between a conductive state and a non-conductive state according to the enable signal received by said second switch; a third switch having a first terminal that is connected electrically to said first terminal of said transistor, a second terminal that is connected electrically to said control terminal of said transistor, and a control terminal that is disposed to receive a compensation signal, said third switch being operable to switch between a conductive state and a non-conductive state according to the compensation signal received by said third switch; and a switching unit connected electrically to said second terminal of said transistor, disposed to receive the compensation signal, and operable to switch between a conductive state and a non-conductive state according to the compensation signal received by said switching unit; wherein said switching unit is configured to transmit one of the enable signal, voltage at said first terminal of said first capacitor, and a reference signal when said switching unit is operated in the conductive state.

2. The OLED-based display device as claimed in claim 1, wherein said switching unit includes a fourth switch having a first terminal that is disposed to receive the reference signal, a second terminal that is connected electrically to said second terminal of said transistor, and a control terminal that is disposed to receive the compensation signal, said fourth switch permitting transmission of the reference signal therethrough to said second terminal of said transistor when said switching unit is operated in the conductive state, and preventing transmission of the reference signal therethrough to said second terminal of said transistor when said switching unit is operated in the non-conductive state.

* * * * *